US009759004B2

(12) United States Patent
Uno et al.

(10) Patent No.: US 9,759,004 B2
(45) Date of Patent: Sep. 12, 2017

(54) OPENING AND CLOSING APPARATUS WITH LOCK

(75) Inventors: Hiroki Uno, Kobe (JP); Takeshi Masuda, Kobe (JP)

(73) Assignee: NABTESCO CORPORATION, Tokyo (JP)

( * ) Notice: Subject to any disclaimer, the term of this patent is extended or adjusted under 35 U.S.C. 154(b) by 307 days.

(21) Appl. No.: 14/343,385

(22) PCT Filed: Aug. 29, 2012

(86) PCT No.: PCT/JP2012/071765
§ 371 (c)(1),
(2), (4) Date: Mar. 6, 2014

(87) PCT Pub. No.: WO2013/035592
PCT Pub. Date: Mar. 14, 2013

(65) Prior Publication Data

US 2015/0054294 A1 Feb. 26, 2015

(30) Foreign Application Priority Data

Sep. 9, 2011 (JP) ..... 2011-197385

(51) Int. Cl.
*E05B 81/20* (2014.01)
*E05F 15/632* (2015.01)
(Continued)

(52) U.S. Cl.
CPC ..... *E05F 15/632* (2015.01); *B61D 19/005* (2013.01); *B61D 19/02* (2013.01);
(Continued)

(58) Field of Classification Search
CPC ..... E05B 47/00; E05B 65/08; E05B 65/0829; E05B 81/20; E05B 81/38; E05B 81/56;
(Continued)

(56) References Cited

U.S. PATENT DOCUMENTS 3,782,034 A * 1/1974 Lynn ..... E05F 15/649 105/341
4,901,474 A * 2/1990 Bayard ..... E05F 15/565 292/144
(Continued)

FOREIGN PATENT DOCUMENTS

CN 101787827 A 7/2010
CN 201614849 U 10/2010
(Continued)

OTHER PUBLICATIONS

An Office Action; "Notice of Reasons for Rejection," issued by the Japanese Patent Office on Jun. 23, 2015, which corresponds to Japanese Patent Application No. 2013-532546 and is related to U.S. Appl. No. 14/343,385; with English language summary.
(Continued)

*Primary Examiner* — James O Hansen
(74) *Attorney, Agent, or Firm* — Studebaker & Brackett PC

(57) ABSTRACT

An opening and closing apparatus with a lock that is provided is capable of safely and promptly closing a sliding door, and also easily performing unlocking with a simple configuration. In an opening and closing apparatus with a lock for opening and closing sliding doors that are provided with elastic members at their door leading ends, output of an electric motor is transmitted to a rack-and-pinion mechanism or a lock mechanism. A control unit controls the electric motor such that a closing operation is performed, the closing operation operates the rack-and-pinion mechanism so as to move the sliding doors to a fully closed position and then displacing a link mechanism in a lock mechanism from an unlocking position to a locking position. Furthermore, the control unit controls the electric motor so as to reduce the
(Continued)

output of the electric motor at a predetermined intermediate time point during the closing operation.

12 Claims, 15 Drawing Sheets

(51) Int. Cl.

| | |
|---|---|
| ***E05F 15/655*** | (2015.01) |
| ***E05B 81/06*** | (2014.01) |
| ***E05B 81/38*** | (2014.01) |
| ***E05B 83/36*** | (2014.01) |
| ***B61D 19/00*** | (2006.01) |
| ***B61D 19/02*** | (2006.01) |
| ***E05B 83/40*** | (2014.01) |
| ***E05B 65/08*** | (2006.01) |
| ***E05B 81/56*** | (2014.01) |
| ***E05F 15/635*** | (2015.01) |
| ***E05B 47/00*** | (2006.01) |
| ***E05F 15/00*** | (2015.01) |
| ***E05F 15/40*** | (2015.01) |
| *E05B 85/24* | (2014.01) |

(52) U.S. Cl.
CPC ..... *E05B 47/00* (2013.01); *E05B 65/08* (2013.01); *E05B 65/0829* (2013.01); *E05B 81/06* (2013.01); *E05B 81/20* (2013.01); *E05B 81/38* (2013.01); *E05B 81/56* (2013.01); *E05B 83/363* (2013.01); *E05B 83/40* (2013.01); *E05F 15/00* (2013.01); *E05F 15/40* (2015.01); *E05F 15/635* (2015.01); *E05F 15/655* (2015.01); *E05B 81/21* (2013.01); *E05B 85/245* (2013.01); *E05Y 2201/22* (2013.01); *E05Y 2201/42* (2013.01); *E05Y 2201/72* (2013.01); *E05Y 2400/56* (2013.01); *E05Y 2400/57* (2013.01); *E05Y 2800/12* (2013.01); *E05Y 2800/73* (2013.01); *E05Y 2800/748* (2013.01); *E05Y 2900/51* (2013.01); *Y10T 292/1043* (2015.04)

(58) Field of Classification Search
CPC . E05B 83/40; E05B 81/06; E05C 3/00; E05C 3/12; E05C 3/22; E05C 3/24; E05C 3/26; E05C 3/28; E05C 3/124; E05C 19/02; E05F 15/00; E05F 15/635; E05F 15/40; E05F 15/632; E05F 15/655; B61D 19/02; B61D 19/005; Y10S 292/46
USPC ..... 292/44, 45, 49, 54, 194, 197, 219, 220; 49/116, 118, 122, 218
See application file for complete search history.

(56) References Cited

U.S. PATENT DOCUMENTS

| | | | | |
|---|---|---|---|---|
| 5,105,131 | A * | 4/1992 | Schap | B60J 5/06 318/282 |
| 5,483,769 | A * | 1/1996 | Zweili | B61D 19/008 49/118 |
| 5,979,114 | A | 11/1999 | Clark et al. | |
| 6,032,416 | A * | 3/2000 | Springer | B60J 5/062 49/118 |
| 6,208,102 | B1 | 3/2001 | Kikuchi et al. | |
| 6,792,717 | B2 * | 9/2004 | Carlsson | E05F 15/646 49/118 |
| 2003/0000149 | A1 * | 1/2003 | Oakley | E05B 83/42 49/449 |
| 2010/0188177 | A1 | 7/2010 | Inage | |

FOREIGN PATENT DOCUMENTS

| | | | |
|---|---|---|---|
| EP | 1721802 | A1 | 11/2005 |
| JP | S55-19366 | A | 2/1980 |
| JP | 2002-067940 | A | 3/2002 |
| JP | 2006-328748 | A | 12/2006 |
| JP | 2008-121242 | A | 5/2008 |
| JP | 2008-121244 | A | 5/2008 |
| TW | M272850 | U | 8/2005 |
| TW | 200833931 | A | 8/2008 |
| TW | M338891 | U | 8/2008 |
| TW | I302887 | B | 11/2008 |
| WO | 2008/056620 | A1 | 5/2008 |

OTHER PUBLICATIONS

An Office Action; "Notice of Reasons for Rejection," issued by the Japanese Patent Office on Nov. 18, 2014, which corresponds to Japanese Patent Application No. 2013-532546 and is related to U.S. Appl. No. 14/343,385; with English language translation.

International Search Report; PCT/JP2012/071765; Nov. 6, 2012.

"Notice of Opinion on Examination," issued by the Taiwanese Patent Office on Jul. 16, 2014, which corresponds to Taiwanese Patent Application No. 101132699 and is related to U.S. Appl. No. 14/343,385; with English language concise explanation of the relevance.

The First Office Action issued by the Chinese Patent Office on Mar. 25, 2015, which corresponds to Chinese Patent Application No. 201280044010.4 and is related to U.S. Appl. No. 14/343,385.

The extended European search report issued by the European Patent Office on Apr. 12, 2016, which corresponds to European Patent Application No. 12830387.2-1607 and is related to U.S. Appl. No. 14/343,385.

* cited by examiner

OPENING AND CLOSING APPARATUS WITH LOCK

TECHNICAL FIELD

The present invention relates to an opening and closing apparatus with a lock for performing opening and closing operations and a locking operation for a vehicle sliding door, using one actuator.

BACKGROUND ART

There are known to be opening and closing apparatuses with a lock that move a sliding door provided in a railway vehicle or the like to open and close, and lock the sliding door at a fully closed position (e.g., see Patent Document 1).

The opening and closing apparatus with a lock recited in Patent Document 1 has a planetary gear mechanism to which a driving force of an actuator is input, and a rack-and-pinion mechanism configured to receive output from the planetary gear mechanism. When sliding doors are opened and closed, a driving force of the actuator is output to the rack-and-pinion mechanism via the planetary gear mechanism, and rotates a pinion. With the rotation of the pinion, a rack that meshes with the pinion moves linearly. Thus, sliding doors, which are coupled to the rack, move linearly. When the sliding doors are closed up to the fully closed position, the sliding doors are locked by a lock mechanism.

The lock mechanism has an engaging member that can rotate around a shaft. The engaging member has a first engaging portion for engaging with a lock pin fixed to the sliding door. When the sliding doors approach the fully closed position while they are being closed, the lock pin comes into contact with the first engaging portion and rotates the engaging member. At the fully closed position, the first engaging portion surrounds the lock pin. The rotation of the engaging member is restricted in this state, and the movement of the lock pin as well as the movement of the sliding doors are restricted.

More specifically, when the sliding doors reach the fully closed position, the pinion that meshes with the rack cannot rotate in the direction of closing the sliding doors any more. When a sun gear in the planetary gear mechanism rotates in the direction of closing the sliding doors in this state, the pinion revolves within an internal gear, and a carrier rotates. With the rotation of the carrier, a lock slider disposed in the vicinity of the carrier is displaced. With this displacement, a link mechanism coupled to the lock slider undergoes deformation from a bent state to a linear state. Then, an end of the link mechanism goes into a second engaging portion having a recessed shape that is formed on the engaging member, and restricts the rotation of the engaging member as mentioned above.

CITATION LIST

Patent Document

Patent Document 1: JP 2008-121244A

DISCLOSURE OF THE INVENTION

Problem to be Solved by the Invention

Usually, an elastic member such as rubber is attached to a door leading end of a sliding door for a railroad vehicle. For example, in the case of two-panel sliding doors, when the pair of sliding doors are at a fully closed position, lips of the elastic members of the respective door leading ends come into contact with each other.

With sliding doors for a railroad vehicle, when the sliding doors are closed, there are cases where the sliding doors are closed up to the fully closed position while a passenger's luggage is stuck therebetween, and the sliding doors are then locked. In such cases, the luggage is in a state of being stuck between the elastic members. In this state, a reaction force from the luggage is exerted on the sliding doors, and this reaction force is transmitted from the sliding doors to the engaging member via the lock pin. For this reason, the engaging member presses an end of a link mechanism engaging with the engaging member, around the rotation centers of the engaging member. That is to say, the engaging member presses the end of the link mechanism in a direction other than the direction in which the link mechanism is disengaged from the engaging member. If an attempt is made to disengage the link mechanism from the second engaging portion of the engaging member in this state, the engaging member pries the end of the link mechanism, and it is difficult to smoothly cancel the rotation restriction on the engaging member by the link mechanism, that is, to smoothly perform unlocking.

In particular, if the output of the actuator for closing the sliding doors is large, the sliding doors are forcibly closed and the lock mechanism is locked even when a piece of luggage or the like is stuck between the door leading ends, and the reaction force from the stuck luggage also tends to be larger. As a result, as the force of closing the sliding doors is larger, it is more difficult to pull out the luggage stuck between the door leading ends.

In that case, it is conceivable that an operator such as an attendant performs unlocking by operating an unlock mechanism, manually operating the link mechanism to disengage the link mechanism from the engaging member, and enabling the engaging member to rotate, and then pulls the luggage out of the sliding doors. However, a large force is required to manually operate the link mechanism that engages with the engaging member with a large prying force, and accordingly, a force amplifying mechanism for amplifying the operator's force is needed. However, if the force amplifying mechanism is added, the scale of the opening and closing apparatus with a lock becomes larger.

On the other hand, in order to prevent the sliding doors from being forcibly locked in the state where a piece of luggage is stuck, it is conceivable to make the output of the actuator small. However, in the case of this configuration, if, for example, a passenger leans against the sliding doors while the operation of closing the sliding doors is being performed in a crowded train, a large resistance force is exerted on the sliding doors, which leads to misrecognition that something is stuck between the doors, and the sliding door cannot be closed promptly. For this reason, it takes time to close the sliding door, which is not preferable in terms of maintenance of scheduled service.

In light of the foregoing situation, an object of the present invention is to provide an opening and closing apparatus with a lock capable of safely and promptly closing a sliding door, and also easily performing unlocking with a simple configuration.

Means for Solving the Problem

An opening and closing apparatus with a lock according to a first aspect of the present invention for achieving the above-stated object is an opening and closing apparatus with a lock for opening and closing a sliding door that is installed at an entrance of a vehicle and is provided with an elastic member at its door leading end, the opening and closing apparatus with a lock including; an actuator; a moving mechanism for moving the sliding door in a predetermined opening direction and closing direction, using output of the actuator; a lock mechanism that operates using output of the actuator and is capable of restricting movement of the sliding door in the opening direction when the sliding door is at a fully closed position; and a control unit for controlling the actuator, wherein the lock mechanism includes an engaging member capable of engaging with a lock member capable of integrally moving with the sliding door, so as to restrict movement of the lock member in the opening direction, and a restricting member capable of being displaced between a locking position for restricting displacement of the engaging member when engaging with the lock member and an unlocking position for allowing displacement of the engaging member, with an operation of the actuator, and the control unit controls the actuator such that a closing operation is performed, the closing operation serving as an operation of operating the moving mechanism so as to move the sliding door along the closing direction to the fully closed position and then displacing the restricting member from the unlocking position to the locking position, and, at a predetermined intermediate time point during the closing operation, controls the actuator so as to reduce the output of the actuator from a predetermined first driving force to a second driving force.

According to this aspect of the invention, the first driving force serving as the output of the actuator is increased until the predetermined intermediate time point during the closing operation. For this reason, a decrease in the closing speed of the sliding door can be suppressed when the sliding door is being displaced toward the fully closed position with the output of the actuator, and it is therefore possible to promptly close the sliding door. For example, even in the case where a large movement resistance is exerted on the sliding door as a result of a passenger leaning against the sliding door while the sliding door is being closed in a crowded train, it is possible to keep promptly closing the sliding door due to the force that closes the sliding door being sufficiently large. In particular, maintenance of scheduled service is strongly demanded for railroad vehicles, and realization of a prompt full-closing operation for the sliding door will significantly contribute to an improvement in the maintenance of scheduled service. Further, the output of the actuator when the restricting member is displaced to the locking position and engages with the engaging member can be made small by reducing the output of the actuator from the first driving force to the second driving force at the predetermined intermediate time point during the closing operation. Therefore, for example, in the case where a piece of luggage is pressing the sliding door toward the opening direction via the elastic member at the fully closed position in a state where the luggage is stuck at the door leading end, if the reaction force from the luggage is large, the sliding door is slightly displaced in the opening direction after reaching the fully closed position once. For this reason, the sliding door is not locked. Also in the case where a piece of luggage is stuck at the door leading end and the sliding door does not move at the closed position, the sliding door is not locked. Accordingly, the sliding door can be prevented from being forcibly locked with a large force. Even if the sliding door is locked in a state where a thin piece of luggage or the like is stuck at the door leading end, the reaction force from the luggage in this case is small. For this reason, the engaging force exerted between the lock member and the engaging member is small, and consequently, the engaging force exerted between the engaging member and the restricting member is also small. Therefore, for example, in the case of manually displacing the restricting member from the locking position to the unlocking position to unlock the sliding door and pull out the luggage stuck at the door leading end, only a small force is required for the manual operation. Accordingly, a force enhancing mechanism such as a pulley mechanism for amplifying manpower for performing manual unlocking is unnecessary. Therefore, it is not necessary to add a new mechanism for manual unlocking or the like to the opening and closing apparatus with a lock, and the configuration of the opening and closing apparatus with a lock can be simplified.

Accordingly, according to the present invention, it is possible to provide an opening and closing apparatus with a lock capable of safely and promptly closing a sliding door, and also easily performing unlocking with a simple configuration.

An opening and closing apparatus with a lock according to a second aspect of the present invention is the opening and closing apparatus with a lock of the first aspect of the present invention, wherein a pair of sliding doors are provided such that door leading ends thereof face each other, and the predetermined intermediate time point during the closing operation is a time point when the sliding doors reach a position where the elastic members of the sliding doors come into contact with each other.

According to this aspect of the invention, the output of the actuator is reduced at the time point when the elastic members of the pair of sliding doors come into contact with each other. Accordingly, when the sliding doors are moving toward each other, the sliding doors can be promptly displaced in the closing direction with the large first driving force from the actuator. Further, for example, in the case where a piece of luggage is stuck at the door leading end and a reaction force from this luggage is large, it is possible to prevent the locking operation from being performed, due to the sliding doors moving in the opening direction against the second driving force of the actuator at an early stage after the luggage is stuck between the sliding doors. Accordingly, the luggage can be pulled out of the sliding doors at an earlier time point, and the damage to the luggage can be made small.

An opening and closing apparatus with a lock according to a third aspect of the present invention is the opening and closing apparatus with a lock of the first or second aspect of the present invention, wherein at a time point before the predetermined intermediate time point during the closing operation, if the actuator is forcibly stopped, the control unit controls the actuator so as to increase the first driving force.

According to this aspect of the invention, for example, if a passenger leans against the sliding door and a large movement resistance is exerted on the sliding door when the sliding door is closed in a crowded train, the output of the actuator is increased. Thus, a decrease in the closing speed of the sliding door can be suppressed, and the prompt closing operation for the sliding door can be reliably performed.

An opening and closing apparatus with a lock according to a fourth aspect of the present invention is the opening and closing apparatus with a lock of the third aspect of the present invention, wherein if a state where the actuator is forcibly stopped continues for a predetermined time, the control unit controls the actuator so as to reduce the output of the actuator, set the output of the actuator to zero, or reverse a direction of the output of the actuator.

According to this aspect of the invention, for example, when a passenger runs into a train and is stuck at the sliding door when the sliding door is closed in a crowded train, the actuator is forcibly stopped. If such a state continues for a predetermined time, the force that moves the sliding door to the closing direction is reduced or set to zero, or the sliding door is opened, thereby enabling the passenger to easily get out of the sliding door. Thus, a person, a piece of luggage, or the like that is stuck at the sliding door can be easily pulled out of the sliding door at a stage before the predetermined intermediate time point.

An opening and closing apparatus with a lock according to a fifth aspect of the present invention is the opening and closing apparatus with a lock of any of the first to fourth aspects of the present invention, wherein at a time point at or after the predetermined intermediate time point during the closing operation, the control unit controls the actuator such that the second driving force is constant.

According to this aspect of the invention, at or after the predetermined intermediate time point during the closing operation, even if a thick piece of luggage or the like is stuck at the door leading end, the output of the actuator is not increased, and the operation of forcibly closing the sliding door is not performed. For this reason, in the case where a thick piece of luggage or the like is stuck at the door leading end, the sliding door can be prevented from being forcibly locked. Accordingly, only a small force is exerted between the engaging member in the lock mechanism and the restricting member. Therefore, even in the case where unlocking needs to be performed by manually operating the restricting member, the restricting member can be easily disengaged from the engaging member with a small force to perform unlocking.

An opening and closing apparatus with a lock according to a sixth aspect of the present invention is the opening and closing apparatus with a lock of any of the first to fifth aspects of the present invention, wherein at a time point at or after the predetermined intermediate time point during the closing operation, when the actuator is forcibly stopped, the control unit controls the actuator so as to reduce the output of the actuator, set the output of the actuator to zero, or reverse a direction of the output of the actuator.

According to this aspect of the invention, at or after the predetermined intermediate time point, for example, in the case where the actuator is forcibly stopped due to a piece of luggage being stuck at the door leading end, the output mode of the actuator is immediately changed. Thus, forcible continuation of the locking operation for the sliding door is suppressed, and it is therefore possible to easily and promptly pull out the luggage or the like from the door leading end by human hands.

An opening and closing apparatus with a lock according to a seventh aspect of the present invention is the opening and closing apparatus with a lock of any of the first to sixth aspects of the present invention, wherein the second driving force is set smaller than a minimum value of the first driving force.

According to this aspect of the invention, the output of the actuator at or after the predetermined intermediate time point can be reliably set to a small value. Thus, at a time point before the predetermined intermediate time point, the sliding door is closed strongly and promptly, and at or after the predetermined intermediate time point, forcible locking of the sliding door can be suppressed in the case where a piece of luggage is stuck at the door leading end.

An opening and closing apparatus with a lock according to an eighth aspect of the present invention is the opening and closing apparatus with a lock of any of the first to seventh aspects of the present invention, wherein the engaging member is configured to be capable of rotating around a predetermined pivoting shaft as a result of coming into contact with the lock member, and the engaging member has a first engaging portion, at least part of the first engaging portion is disposed on the opening direction side with respect to the lock member when the sliding door is at the fully closed position, and a second engaging portion that engages with the restricting member located at the locking position, and the rotation of the engaging member is restricted by the engagement between the restricting member and the second engaging portion.

According to this aspect of the invention, smooth engagement and the disengagement between the lock member and the engaging member can be realized. Further, when the sliding door is at the fully closed position, the engaging member restricts displacement of the lock member that is hooked at the engaging member, as a result of the rotation of the engaging member being restricted by the restricting member. Consequently, in the case where a piece of luggage or the like is stuck at the sliding door, a reaction force from the luggage or the like is transmitted from the lock member to the engaging member, and the engaging member presses the restricting member around the pivoting shaft. Since this pressing force acts as a prying force, it is difficult, due to this prying force, to pull the restricting member out of the engaging member. However, according to this aspect of the invention, the sliding door is locked only when the reaction force from the luggage is small, and it is therefore easy to perform the operation of manually pulling the restricting member out of the engaging member, that is, the manual unlocking operation.

An opening and closing apparatus with a lock according to a ninth aspect of the present invention is the opening and closing apparatus with a lock of the eighth aspect of the present invention, wherein the engaging member has a third engaging portion that engages with the restricting member so as to restrict displacement of the restricting member to the locking position when the sliding door is at an opened position.

According to this aspect of the invention, when the sliding door is at the opened position, displacement of the restricting member to the locking position is restricted. Accordingly, it is possible to reliably suppress unintended displacement of the restricting member while the sliding door is being displaced from the opened position to the fully closed position.

An opening and closing apparatus with a lock according to a tenth aspect of the present invention is the opening and closing apparatus with a lock of any of the first to ninth aspects of the present invention, further comprising a planetary gear mechanism for selectively distributing the output of the actuator to one of the moving mechanism and the lock mechanism, wherein the planetary gear mechanism has an input portion to which the output of the actuator is input, a first output portion capable of transmitting the output to the moving mechanism, and a second output portion capable of transmitting the output to the restricting member, the planetary gear mechanism being capable of transmitting the output from the first output portion to the moving mechanism when the sliding door is at the opened position, and capable of transmitting the output from the second output portion to the restricting member when the sliding door is at the fully closed position.

According to this aspect of the invention, the configuration for distributing the output of the actuator can be accommodated in a compact space, and consequently, the configuration of the opening and closing apparatus with a lock can be further simplified.

An opening and closing apparatus with a lock according to an eleventh aspect of the present invention is the opening and closing apparatus with a lock of any of the first to tenth aspects of the present invention, wherein the actuator includes an electric motor.

According to this aspect of the present invention, an electric motor can be used as an actuator with a simple configuration, and the configuration of the opening and closing apparatus with a lock can be more simplified.

An opening and closing apparatus with a lock according to a twelfth aspect of the present invention is the opening and closing apparatus with a lock of the eleventh aspect of the present invention, wherein the control unit calculates the predetermined intermediate time point based on a rotation amount of an output shaft of the electric motor.

According to this aspect of the invention, during the closing operation, it is possible to easily calculate that the predetermined intermediate time point has been reached, based on the rotation amount of the output shaft of the electric motor.

Effects of the Invention

According to the present invention, it is possible to provide an opening and closing apparatus with a lock capable of safely and promptly closing a sliding door, and also easily performing unlocking with a simple configuration.

BRIEF DESCRIPTION OF THE DRAWINGS

FIG. 9(*a*) shows a state where a door lock detection switch is in an off state, and FIG. 9(*b*) shows a state where the door lock detection switch is in an on state.

FIG. 12(*a*) is a schematic front view of a main part of the surroundings of the sliding doors, and FIG. 12(*b*) is a diagram showing the lock mechanism as viewed from the lower side.

DESCRIPTION OF EMBODIMENTS

Hereinafter, modes for carrying out the present invention will be described with reference to the drawings. Note that the present invention is not limited to the exemplary modes described in the following embodiment, and is widely applicable to opening and closing apparatuses with a lock for opening and closing a sliding door to which an elastic member is attached at a door leading end of the sliding door, in a lockable manner.

Figure 1:
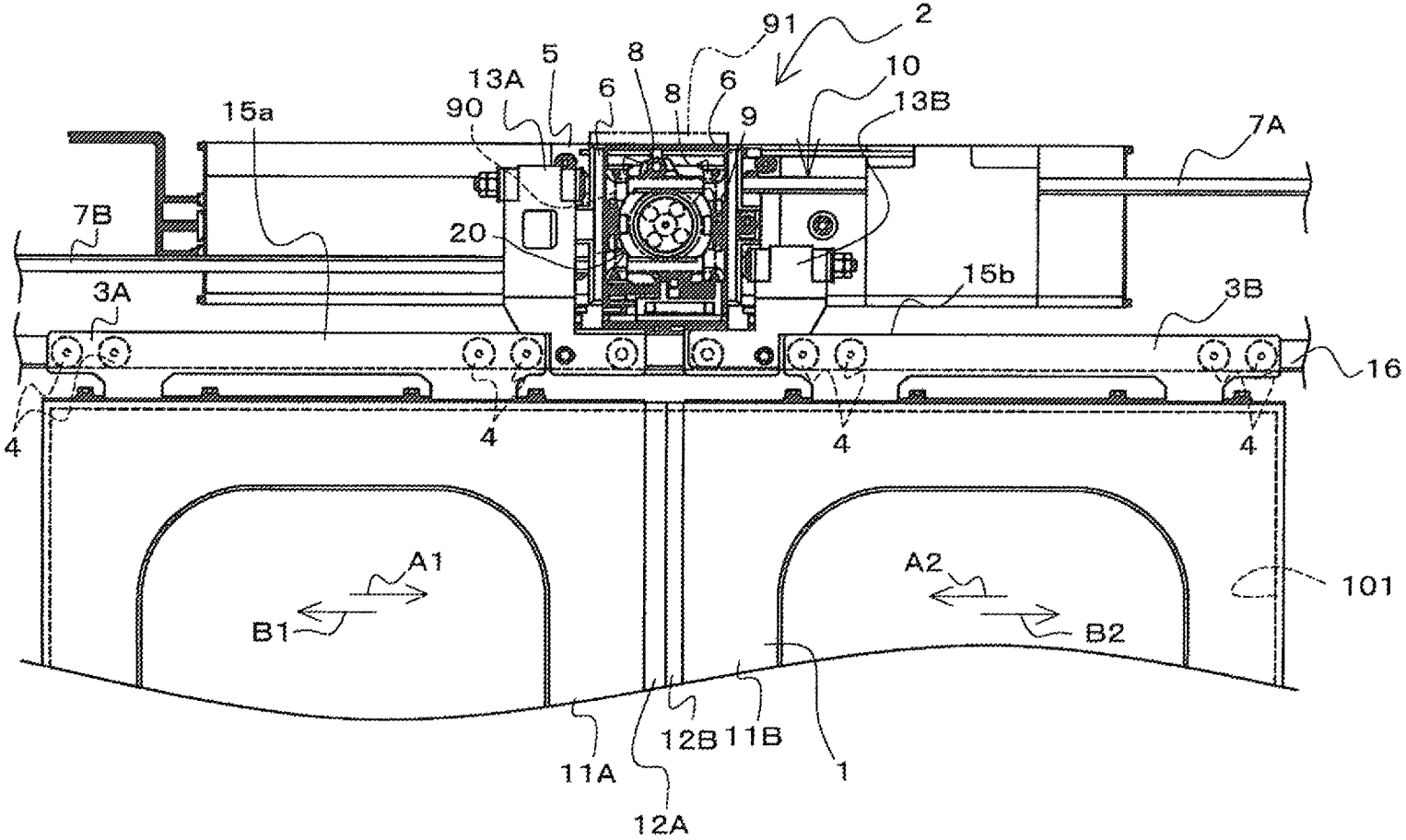
FIG. 1 is a front view showing an embodiment in which an opening and closing apparatus with a lock is installed on openable/closable doors for a vehicle.
Figure 2:
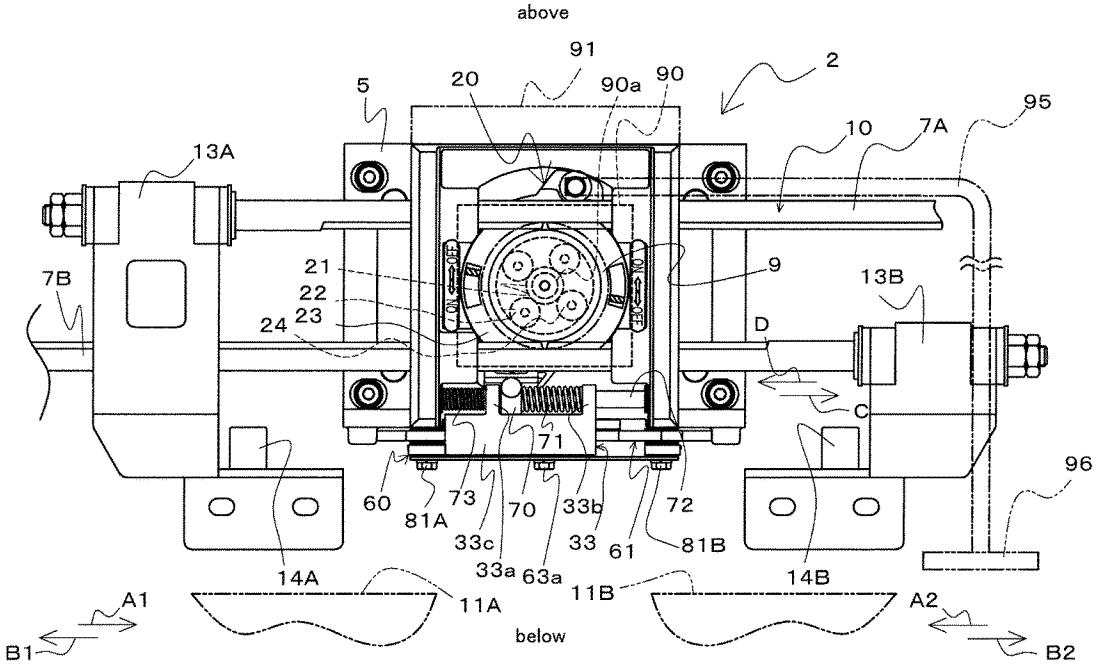
FIG. 2 is a front view of a main part of a configuration of the opening and closing apparatus with a lock in an unlocked state.
Figure 3:
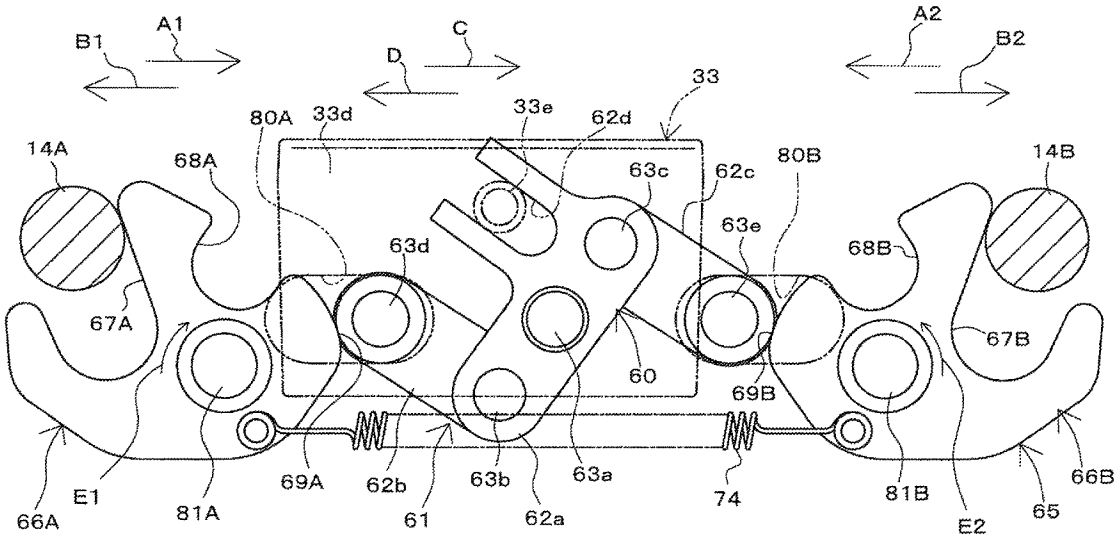
FIG. 3 is a schematic view of the lock mechanism shown in FIG. 2 as viewed from below, showing a state where sliding doors are performing a displacement operation.
Figure 4:
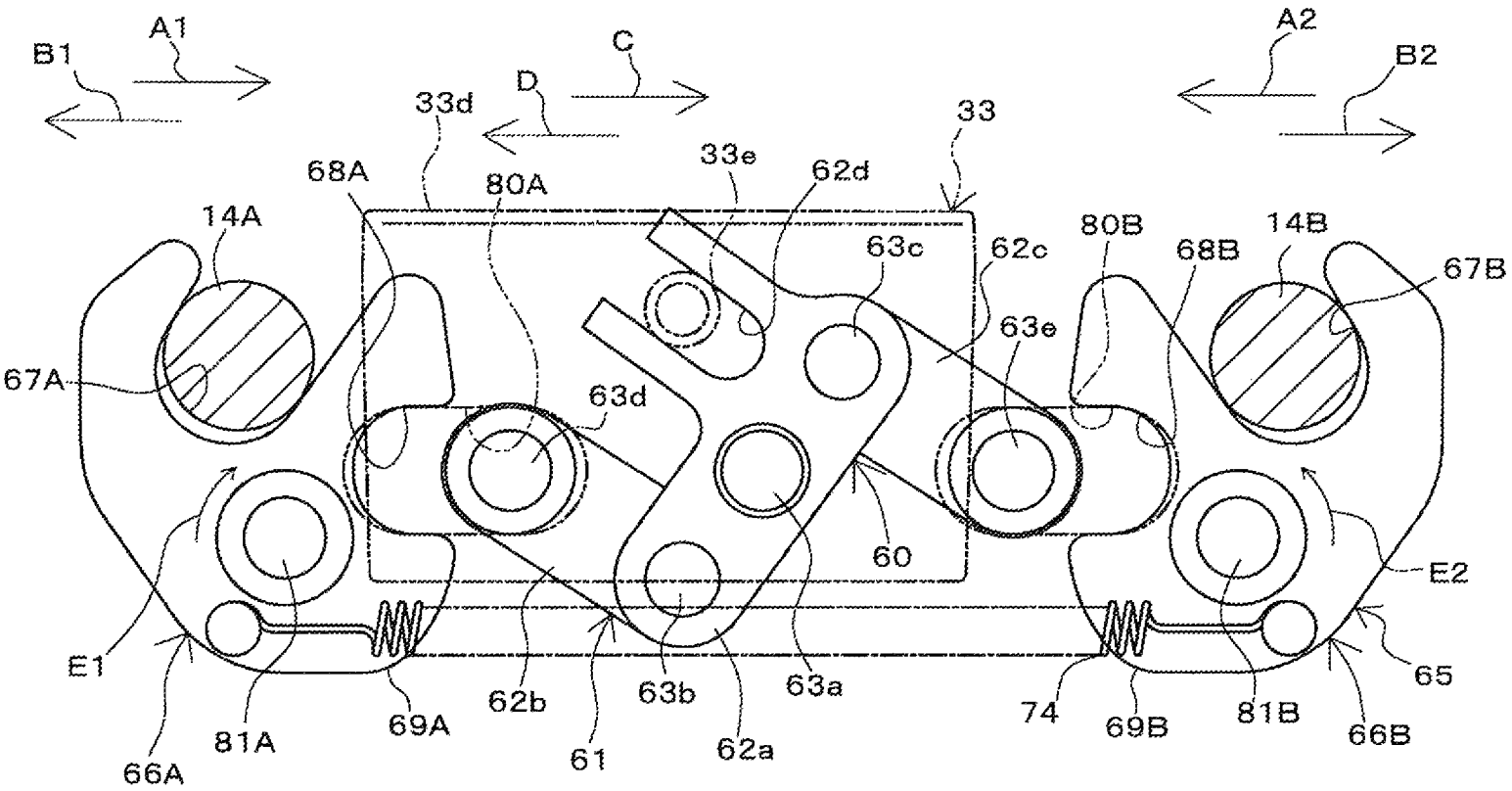
FIG. 4 is a schematic view of the lock mechanism as viewed from below, showing a state where restriction on displacement of a link mechanism in the lock mechanism is canceled.
Figure 5:
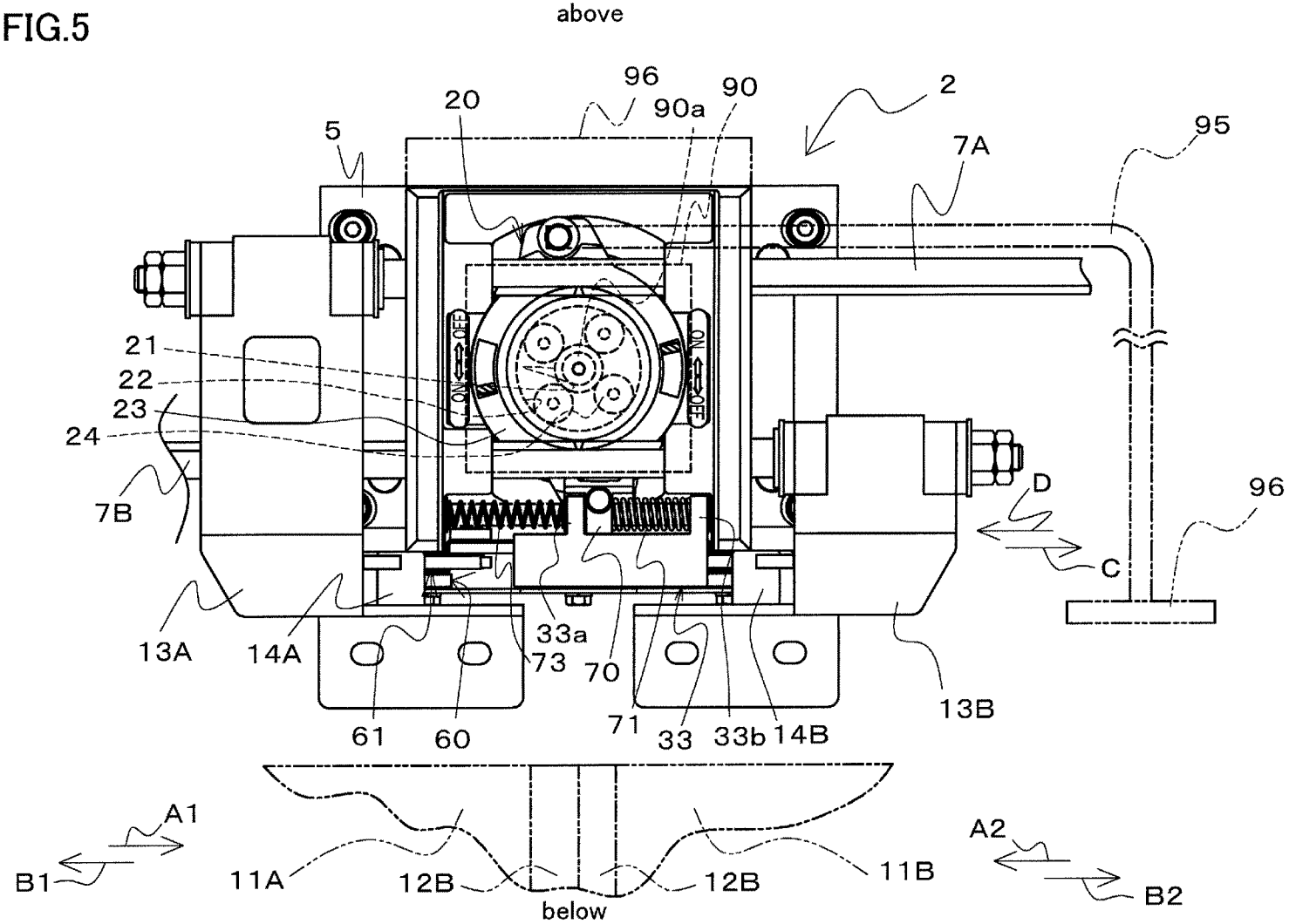
FIG. 5 is a front view of a main part of a configuration of the opening and closing apparatus with a lock in a locked state.
Figure 6:
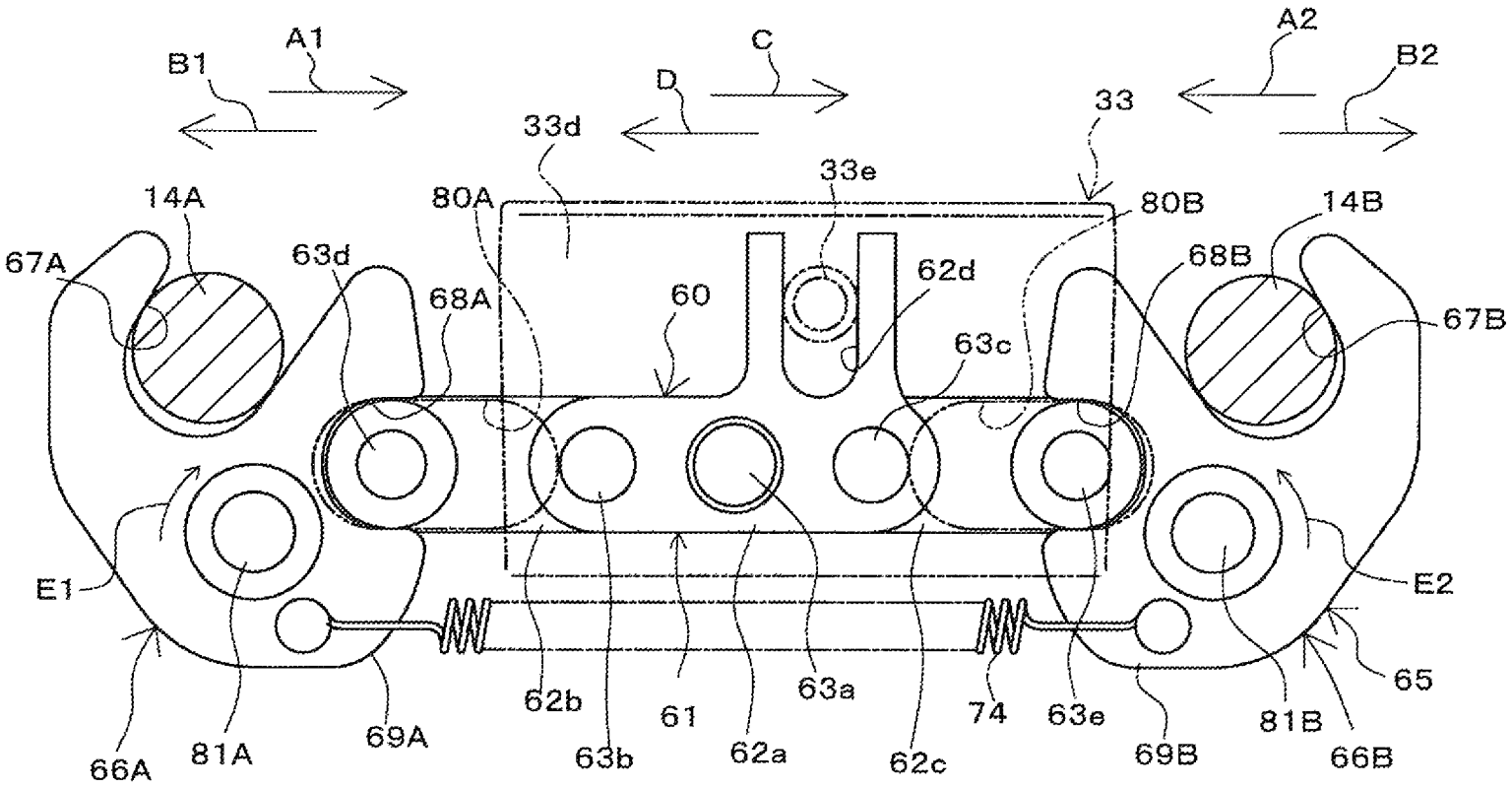
FIG. 6 is a schematic view of the lock mechanism shown in FIG. 5 as viewed from below, showing a state where the link mechanism in the lock mechanism has locked the sliding doors.
Figure 7:
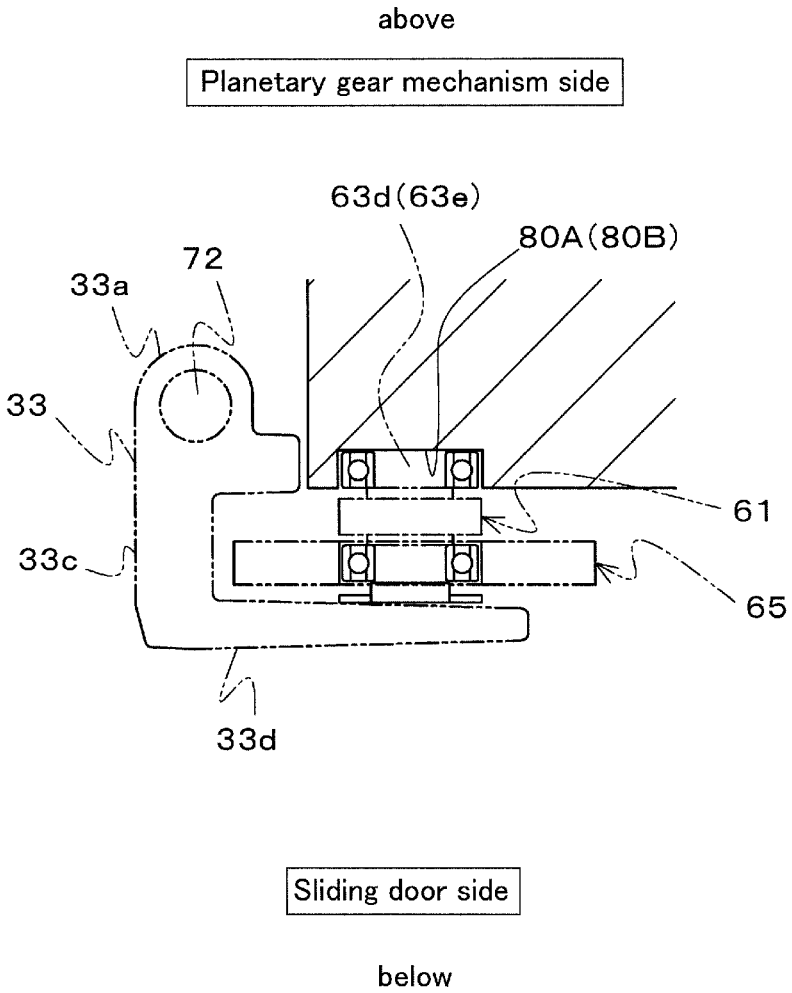
FIG. 7 is a partial schematic cross-sectional view of part of the lock mechanism and a lock slider, as viewed from the side of the opening and closing apparatus with a lock.
Figure 8:
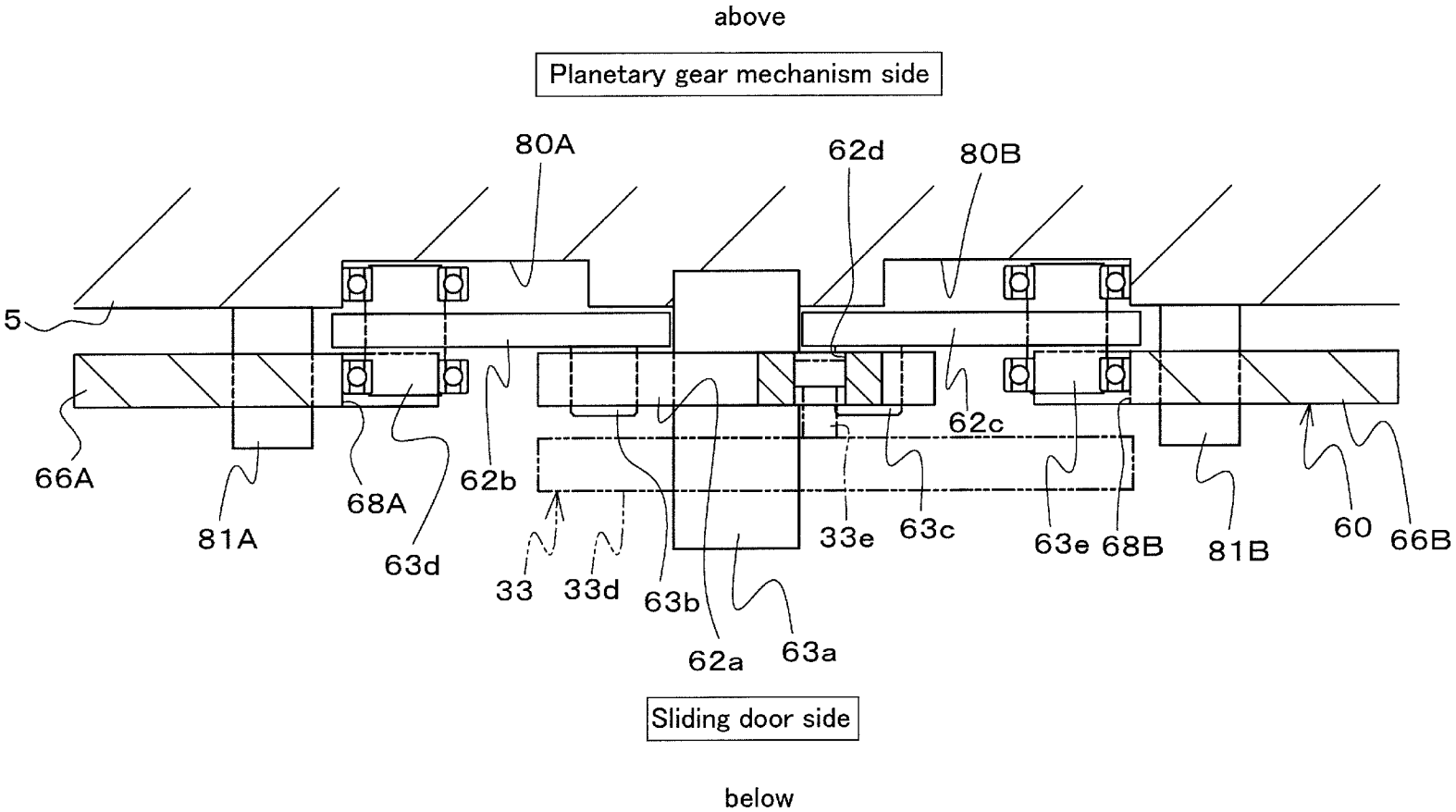
FIG. 8 is a partial schematic cross-sectional view of the lock mechanism in a state of locking the sliding doors, as viewed from the horizontal direction.

FIG. 1 is a front view showing an embodiment in which an opening and closing apparatus with a lock is installed on openable/closable doors for a vehicle. FIG. 2 is a front view of a main part of a configuration of the opening and closing apparatus with a lock in an unlocked state. FIG. 3 is a schematic view showing the lock mechanism shown in FIG. 2 as viewed from below, showing a state where sliding doors are performing a displacement operation. FIG. 4 is a schematic view of the lock mechanism as viewed from below, showing a state where restriction on displacement of a link mechanism in the lock mechanism is canceled. FIG. 5 is a front view of a main part of a configuration of the opening and closing apparatus with a lock in a locked state. FIG. 6 is a schematic view of the lock mechanism shown in FIG. 5 as viewed from below, showing a state where the link mechanism in the lock mechanism has locked the sliding doors. FIG. 7 is a partial schematic cross-sectional view of part of the lock mechanism and a lock slider, as viewed from the side of the opening and closing apparatus with a lock. FIG. 8 is a partial schematic cross-sectional view of the lock mechanism in a state of locking the sliding doors, as viewed from the horizontal direction.

Openable/closable doors 1 for a vehicle shown in FIG. 1 are configured as doors that can open and close an entrance 101 formed in a side wall of a vehicle such as a railroad vehicle, and include a pair of left and right sliding doors 11A, 11B, which are two-panel sliding doors. Door leading ends of the sliding doors 11A, 11B face each other. The opening and closing apparatus with a lock 2 is provided in order to open and close the sliding doors 11A, 11B between a fully opened position and a fully closed position, and to lock the sliding doors 11A, 11B when the sliding doors 11A, 11B are at the fully closed position. Note that FIG. 1 shows the sliding doors 11A, 11B at the fully closed position. The openable/closable doors 1 for a vehicle are opened and closed and are automatically locked so as not to suddenly open when in the closed state, by the opening and closing apparatus with a lock 2 according to an embodiment of the present invention. The opening and closing apparatus with a lock 2 is installed at the entrance 101.

Referring to FIG. 2, the opening and closing apparatus with a lock 2 includes an electric motor (actuator) 90, a rack-and-pinion mechanism (moving mechanism) 10, a planetary gear mechanism 20, a lock mechanism 60, and a control unit 91 for controlling the electric motor 90.

Referring again to FIG. 1, the sliding doors 11A, 11B that are opened and closed by the opening and closing apparatus with a lock 2 will be described first. The sliding doors 11A, 11B are provided so as to be capable of reciprocating along a guide rail 16 installed horizontally above the entrance 101. More specifically, hangers 3A, 3B are fixed to upper edges of the sliding doors 11A, 11B, respectively, and door rollers 4 are rotatably supported to the hangers 3A, 3B. These door rollers 4 are configured to be capable of rolling on the guide rail 16.

A plate-like base 5 is fixed above the entrance 101 on a side wall (housing) of the vehicle. Two racks 7A, 7B are supported to a rack support 6 fixed to the base 5. The racks 7A, 7B are disposed with their longitudinal directions being aligned with the horizontal direction, which is parallel to the guide rail 16, and are supported to a slide support portion 8 so as to be capable of sliding in the longitudinal directions.

The two racks 7A, 7B are disposed parallel to each other so as to form an appropriate gap therebetween in the up-down direction, and are disposed such that their teeth portions face each other. A pinion 9 is rotatably disposed so as to simultaneously mesh with both teeth portions of the two racks 7A, 7B. The pinion 9 is disposed above the entrance 101 at a central position in the left-right direction of the entrance 101, so as to be vertically sandwiched by the two racks 7A, 7B.

Arm members 13A, 13B are installed at ends of the two racks 7A, 7B, respectively. The arm members 13A, 13B are fixed to the hangers 3A, 3B via coupling members 15*a*, 15*b*, respectively. That is to say, one end of each rack 7A, 7B is coupled to the corresponding sliding door 11A, 11B via the arm member 13A, 13B. The racks 7A, 7B and the pinion 9 constitute a rack-and-pinion mechanism 10. The two sliding doors 11A, 11B are driven to open and close by the rack-and-pinion mechanism 10. Note that the rack-and-pinion mechanism 10 also plays a role of realizing symmetrical opening and closing movement of the sliding doors 11A, 11B by connecting the left and right sliding doors 11A, 11B to each other.

The sliding doors 11A, 11B can move along the longitudinal direction of the guide rail 16 in closing directions A1, A2, in which the sliding doors 11A, 11B approach each other, and in opening directions B1, B2, in which the sliding doors 11A, 11B move away from each other. Note that the opening direction B1 of the sliding door 11A is opposite to the opening direction B2 of the sliding door 11B. The closing direction A1 of the sliding door 11A is opposite to the closing direction A2 of the sliding door 11B.

Elastic members 12A, 12B are disposed at the door leading ends of the sliding doors 11A, 11B, that is, at ends in the closing directions A1, A2 of the sliding doors 11A, 11B. When the sliding doors 11A, 11B are located at the fully closed position shown in FIG. 1, the gap between the sliding doors 11A, 11B are closed up as a result of the elastic members 12A, 12B coming into contact with each other. The elastic members 12A, 12B extend from the upper ends to the lower ends of the sliding doors 11A, 11B at the door leading ends of the sliding doors 11A, 11B. The elastic members 12A, 12B close the entrance 101 of the vehicle, where the sliding doors 11A, 11B are disposed, in conjunction with each other by coming into contact with each other.

As shown in FIG. 2, lock pins (lock members) 14A, 14B, which extend vertically upward, are fixed to the pair of arm members 13A, 13B, respectively. With this configuration, the lock pins 14A, 14B can move integrally with the sliding doors 11A, 11B. When the sliding doors 11A, 11B are at the fully closed position, the lock pins 14A, 14B are constrained by a lock mechanism 60, which will be described later, and the movement of the pair of sliding doors 11A, 11B, particularly, the movement of the pair of sliding doors 11A, 11B in the opening directions B1, B2 is thereby locked.

The planetary gear mechanism 20 is supported to the base 5. The planetary gear mechanism 20 is provided in order to selectively distribute the output of the electric motor 90 to either the rack-and-pinion mechanism 10 or the lock mechanism 60. The planetary gear mechanism 20 has a sun gear (input portion) 21, an internal gear (first output portion) 22, a carrier (second output portion) 23, and planetary gears 24.

The sun gear 21 is rotatably supported to a bearing or the like (not shown). A plurality of planetary gears 24 are disposed on the outer circumference of the sun gear 21, and are configured to mesh with the sun gear 21 and to be able to rotate and revolve. The internal gear 22 has internal teeth that mesh with the planetary gears 24. The carrier 23 supports the planetary gears 24 so as to be capable of revolving around the sun gear 21. The sun gear 21, the internal gear 22, and the carrier 23 are disposed on the same axis as axis of the pinion 9, and are disposed such that they are capable of relative rotation with respect to one another.

An output shaft 90*a* of the electric motor 90, which is of the direct-drive type capable of forward and reverse rotation, is connected to the sun gear 21, and the output of the electric motor 90 is input to the sun gear 21. Note that the sun gear 21 and the output shaft 90*a* may be connected via an appropriate deceleration mechanism. The internal gear 22 is connected to the pinion 9 in the rack-and-pinion mechanism 10 with a bolt or the like (not shown), and can transmit the output of the electric motor 90 to the rack-and-pinion mechanism 10. Thus, the rack-and-pinion mechanism 10 can move the sliding doors 11A, 11B in the opening directions B1, B2 and the closing directions A1, A2 using the output of the electric motor 90.

The carrier 23 is connected to a traction member 70. The traction member 70 is provided in order to draw the lock slider 33 for switching between a locked state and an unlocked state of the sliding doors 11A, 11B. The carrier 23 is capable of transmitting the output of the electric motor 90 to a link mechanism (restricting member) 61, which will be described later, in the lock mechanism 60, via the traction member 70, a torque limiter spring 71, and the lock slider 33.

The traction member 70 and the lock slider 33 are installed so as to be capable of reciprocating in the left-right direction along a guide shaft 72 that extends parallel to the racks 7A, 7B and is fixed to the rack support 6, and form a switching mechanism for switching between the locked state and the unlocked state. The traction member 70 is coupled to the carrier 23 so as to be capable of moving in a locking direction C and an unlocking direction D with the rotation of the carrier 23. The torque limiter spring 71, such as a coil spring, is installed between the traction member 70 and the lock slider 33. The torque limiter spring 71 exerts an elastic force on the traction member 70 and the lock slider 33 so as to press the traction member 70 against the lock slider 33. That is to say, the torque limiter spring 71 is installed so as to suppress relative movement of the traction member 70 with respect to the lock slider 33.

An attachment portion 33*a* and an attachment portion 33*b* are provided at the upper end of the lock slider 33. The attachment portion 33*a* and the attachment portion 33*b* are installed so as to be spaced apart by a predetermined gap in the locking direction C, and are formed so as to be capable of sliding with the guide shaft 72. Note that the locking direction C is a direction parallel to the opening directions B1, B2. The unlocking direction D is the direction opposite to the locking direction C. As shown in FIGS. 2, 3, and 7, the lock slider 33 includes a front face portion 33*c* that extends downward from the attachment portion 33*a* and the attachment portion 33*b*, and a bottom face portion 33*d* that is formed to be bent by 90 degrees from the lower end of the front face portion 33*c* toward the paper background direction in FIG. 2. The traction member 70 is attached to the guide shaft 72 at a position between the attachment portion 33*a* and the attachment portion 33*b*.

The torque limiter spring 71 attached to the guide shaft 72 is disposed between the traction member 70 and the attachment portion 33*b* located at the leading end in the locking direction C of the lock slider 33. The torque limiter spring 71 is attached in a state of being elastically compressed in its axis direction. Thus, the traction member 70 receives a biasing force toward the attachment portion 33*a*, and the traction member 70 is retained in a state of being in contact with the attachment portion 33*a*.

A lock spring 73 is installed on the guide shaft 72 so as to bias the attachment portion 33*a* of the lock slider 33 in the locking direction C. The lock spring 73 suppresses the lock slider 33 at a locking position from returning to an unlocking position.

As shown in FIGS. 6 and 8, the bottom face portion 33*d* of the lock slider 33 is provided with a projecting shaft 33*e* that projects upward. A roller is rotatably attached to the upper end of the projecting shaft 33*e*. The projecting shaft 33*e* is inserted in a groove 62*d* formed on the periphery of a link member 62*a*, which will be described later. With this configuration, when the lock slider 33 is displaced in the locking direction C or the unlocking direction D, the projecting shaft 33*e* of the lock slider 33 shifts the position of the link member 62*a*, and consequently, the orientation (position) of the link mechanism 61 changes. Note that an insertion hole (not shown), which is an elongated hole in which a pin 63*a* supported to the base 5 is inserted, is formed in the bottom face portion 33*d*. Thus, the lock slider 33 can move in the locking direction C and the unlocking direction D with respect to the pin 63*a*.

Next, the lock mechanism 60 for locking the sliding doors 11A, 11B at the fully closed position will be described in detail. The lock mechanism 60 is configured to operate using the output of the electric motor 90 (see FIG. 2), and is configured to restrict the movement of the sliding doors 11A, 11B in the opening directions B1, B2 when the sliding doors 11A, 11B are at the fully closed position.

The lock mechanism 60 is a mechanism that operates horizontally, and is installed so as to be adjacent to the upper part (the planetary gear mechanism 20 side) of the bottom face portion 33*d* of the lock slider 33. The lock mechanism 60 includes the link mechanism (restricting member) 61 and a link retaining mechanism 65 that operates horizontally.

The link mechanism 61 is configured to be capable of undergoing deformation to a bent state and a straight state by undergoing horizontal deformation. FIGS. 6 and 8 show the link mechanism 61 in a straight state (locking position). The link mechanism 61 is formed by connecting three links 62*a*, 62*b*, 62*c*. The center link 62*a* is coupled to the connecting pin 63*a* at its center in the longitudinal direction, and can thereby pivot with respect to the base 5. The center link 62*a* is provided with a groove 62*d* that is formed so as to be a cut-out in the outer periphery of the link 62*a*. As described above, the roller of the projecting shaft 33*e* is inserted in the groove 62*d*. One end of the link 62*b* is connected to one end of the center link 62*a* via a connecting pin 63*b* so as to be capable of relative rotation. One end of the link 62*c* is connected to the other end of the link 62*a* via a connecting pin 63*c* so as to be capable of relative rotation. The links 62*b*, 62*c* are provided with pins 63*d*, 63*e*, respectively.

The pins 63*d*, 63*e* are located at the respective ends of the link mechanism 61. The upper ends of the pins 63*d*, 63*e* are inserted respectively in guide grooves 80A, 80B on the base 5 that extend in a direction parallel to the locking direction C. Thus, the pins 63*d*, 63*e* are installed so as to be capable of moving along the guide grooves 80A, 80B, respectively. That is to say, the movement of the pins 63*d*, 63*e* is guided by the guide grooves 80A, 80B.

Note that rollers are rotatably attached to the upper ends of the respective pins 63*d* and 63*e* that are inserted in the guide grooves 80A, 80B. Thus, frictional resistance between the pins 63*d*, 63*e* and the guide grooves 80A, 80B is reduced to make the movement of the pins 63*d*, 63*e* smooth. Further, rollers are also rotatably attached to the lower ends of the pins 63*d*, 63*e*. The rollers at the lower ends of the pins 63*d*, 63*e* are provided in order to reduce frictional resistance caused due to their relative movement with respect to engaging members 66A, 66B, which will be described later, and to stabilize the locking operation.

In the link mechanism 61 having the above-described configuration, the link 62*a* connected to the projecting shaft 33*e* pivots around the pin 63*a* with displacement of the lock slider 33 in the locking direction C or the unlocking direction D. Thus, the link mechanism 61 undergoes deformation to a linear state and a bent state.

The link retaining mechanism 65 includes a pair of engaging members 66A, 66B, and a connection spring 74 for connecting the pair of engaging members 66A, 66B to each other. The pair of engaging members 66A, 66B are disposed in the vicinity of the two ends of the link mechanism 61, so as to be symmetrical in a direction parallel to the locking direction C around the connecting pin 63*a* of the link mechanism 61, and are configured to be capable of pivoting on a horizontal plane around pivoting shafts 81A, 81B.

The engaging members 66A, 66B are provided so as to be capable of engaging with the lock pins 14A, 14B so as to restrict movement of the lock pins 14A, 14B in the opening directions B1, B2. The peripheral portions of the engaging members 66A, 66B include first engaging portions 67A, 67B and second engaging portions 68A, 68B, which are each formed in a recessed shape, and third engaging portions 69A, 69B. The engaging members 66A, 66B are supported to the base 5 via the pivoting shafts 81A, 81B. The engaging members 66A, 66B can rotate around the pivoting shafts 81A, 81B by coming into contact with the lock pins 14A, 14B that are displaced in the opening directions B1, B2 or the closing directions A1, A2.

As shown in FIG. 3, the first engaging portions 67A, 67B of the engaging members 66A, 66B are each formed in a hook shape as viewed from below. In a state where the lock pins 14A, 14B are not engaged with the engaging members 66A, 66B, the lock pins 14A, 14B and portions of the first engaging portions 67A, 67B face each other in a direction parallel to the locking direction C.

In a state where the link retaining mechanism 65 does not receive an external force, the engaging members 66A, 66B receive a force from the connection spring 74, and are retained in the state shown in FIG. 3. That is to say, the engaging members 66A, 66B are retained in a state where openings of the first engaging portions 67A, 67B face toward the opening directions B1, B2. At this time, the third engaging portions 69A, 69B are opposed to each other at the closest positions of the outer peripheral portions of the engaging members 66A, 66B in a direction parallel to the opening directions B1, B2. The third engaging portions 69A, 69B are in contact with the roller at the lower end of the pins 63*d*, 63*e* in the link mechanism 61. Thus, when the sliding doors 11A, 11B are at the opened position, the third engaging portions 69A, 69B engage with the link mechanism 61 so as to restrict displacement of the link mechanism 61 from the unlocking position to the locking position. That is to say, the third engaging portions 69A, 69B restrict the movement of the link mechanism 61 to extend from a bent state to a straight state.

The lock slider 33 is connected to the link 62*a* in the link mechanism 61 via the projecting shaft 33*e*. Accordingly, when the link mechanism 61 is retained in a bent state by the engaging members 66A, 66B, the movement of the lock slider 33 in the locking direction C is constrained.

On the other hand, when the lock pins 14A, 14B reach the vicinity of the fully closed position as a result of moving in the closing directions A1, A2, the lock pins 14A, 14B bias edge portions of the first engaging portions 67A, 67B of the engaging members 66A, 66B as shown in FIG. 4. Thus, the engaging members 66A, 66B pivot in rotational directions E1, E2 around the pivoting shafts 81A, 81B, against a biasing force of the connection spring 74. Accordingly, the second engaging portions 68A, 68B approach the link mechanism 61.

In a state where the sliding doors 11A, 11B are at the fully closed position, the lock pins 14A, 14B engage with the first engaging portions 67A, 67B, and part of the first engaging portions 67A, 67B are located on the opening direction B1, B2 sides with respect to the lock pins 14A, 14B, respectively. The positions of the second engaging portions 68A, 68B are positions where they can engage with the pins 63*d*, 63*e* located at the ends of the link mechanism 61. At this time, the third engaging portions 69A, 69B of the engaging members 66A, 66B are located away from the link mechanism 61, and the link mechanism 61 can undergo deformation from a bent posture to a straight posture.

At this time, if the projecting shaft 33*e* of the lock slider 33 moves in the locking direction C, the link 62*a* is displaced so as to pivot around the pin 63*a*. The link mechanism 61 thereby transitions from a bent state to a straight state. That is to say, the link mechanism 61 is displaced from the unlocking position shown in FIG. 4 to the locking position shown in FIG. 6. At the locking position, the pins 63*d*, 63*e* located at the ends of the link mechanism 61 engage with the second engaging portions 68A, 68B of the engaging members 66A, 66B. The rotation of the engaging members 66A, 66B around the pivoting shafts 81A, 81B is thereby restricted. Accordingly, the movement of the lock pins 14A, 14B engaging with the engaging members 66A, 66B in the opening directions B1, B2 is restricted by the first engaging portions 67A, 67B.

Next, the control unit 91 for controlling the lock mechanism 60 having the above-described configuration and the like will be described. As shown in FIG. 2, the control unit 91 is disposed in the vicinity of the planetary gear mechanism 20, for example, and controls driving of the electric motor 90. The control unit 91 includes a CPU (Central Processing Unit), a ROM (Read Only Memory), and a RAM (Random Access Memory). The control unit 91 controls switching between an on state and an off state of driving of the electric motor 90, the rotational direction of the output shaft 90*a* of the electric motor 90, and the driving force of the electric motor 90, for example.

Figure 9A:
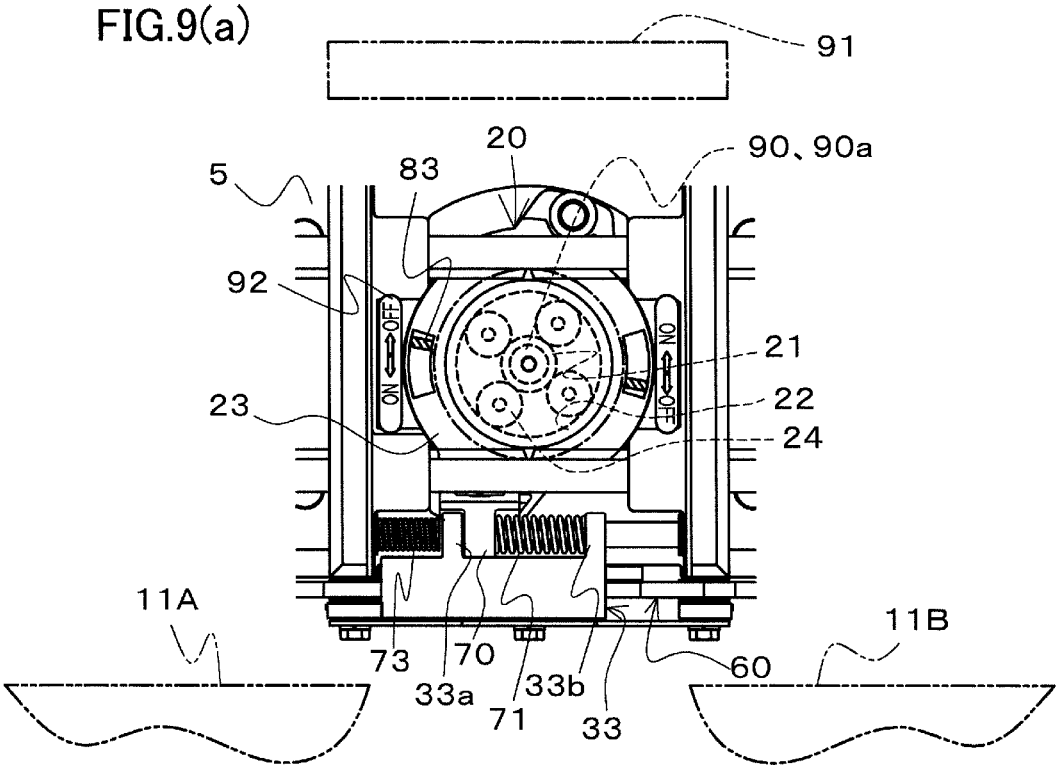
FIGS. 9(*a*) and 9(*b*) are front views showing the surroundings of a carrier in a planetary gear mechanism.
Figure 9B:
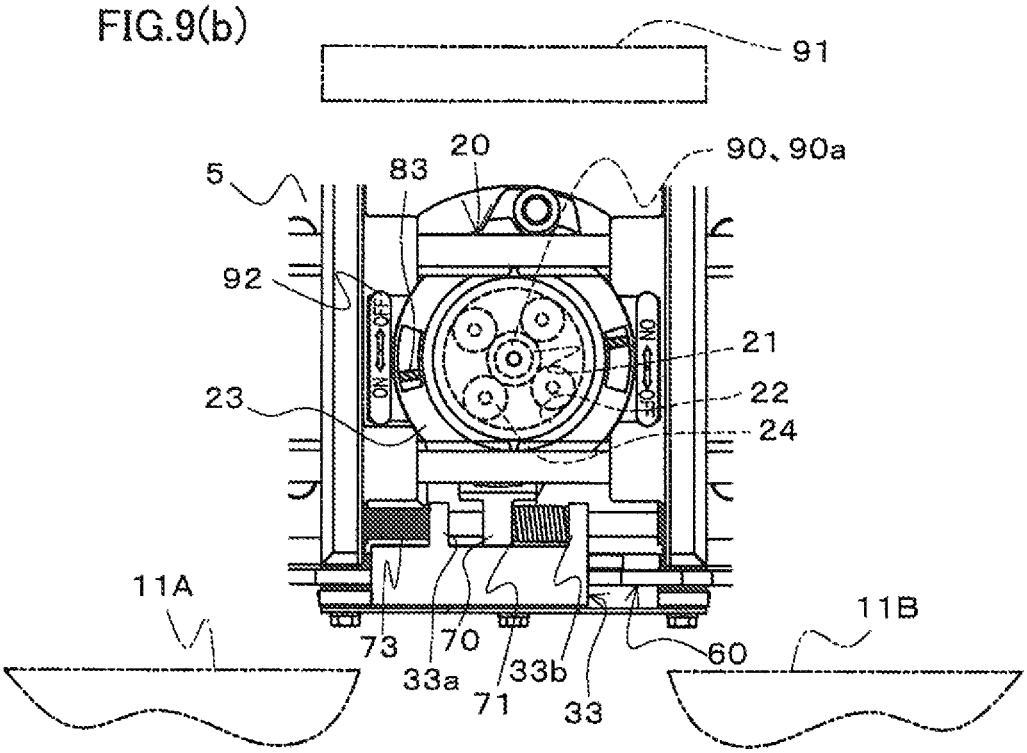

The control unit 91 is connected to a door lock detection switch 92, which is shown in FIG. 9(*a*). FIGS. 9(*a*) and 9(*b*) are front views of the surroundings of the carrier 23 in the planetary gear mechanism 20. FIG. 9(*a*) shows a state where the door lock detection switch 92 is in an off state, and FIG. 9(*b*) shows a state where the door lock detection switch 92 is in an on state.

The door lock detection switch 92 is provided in order to detect whether or not locking by the lock mechanism 60 has been completed, and is fixed to the base 5. The door lock detection switch 92 is configured to switch between an on state and an off state by a permanent magnet 83 fixed to the outer periphery of the carrier 23. That is to say, the door lock detection switch 92 attached to the base 5 is configured to be switched as a result of the permanent magnet 83 moving with the rotation of the carrier 23.

The door lock detection switch 92 is in an off state at the position of the carrier 23 when the sliding doors 11A, 11B are operating with a normal movement resistance. At this time, the carrier 23 is at a position where the traction member 70 is caused to come into contact with the attachment portion 33*a*. On the other hand, when the output shaft 90*a* of the electric motor 90 further rotates in a state where the movement of the sliding doors 11A, 11B is stopped, the sun gear 21 rotates the planetary gears 24, and consequently, the carrier 23 can rotate. As shown in FIG. 9(*b*), when the carrier 23 rotates by a predetermined amount, the permanent magnet 83 approaches the door lock detection switch 92. Thus, the door lock detection switch 92 is turned on. Then, an electric signal indicating that the door lock detection switch 92 has been turned on is transmitted to the control unit 91.

Figure 10:
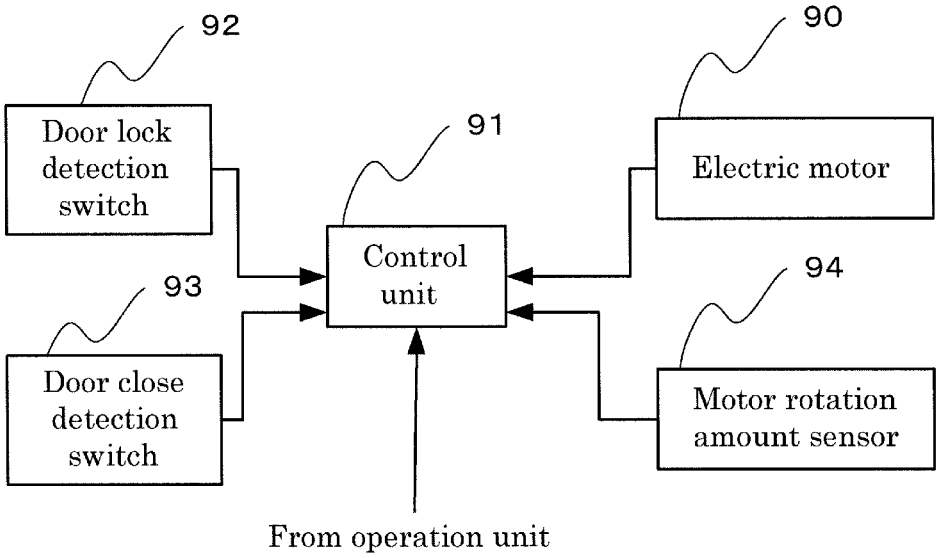
FIG. 10 is a block diagram showing an electric configuration of a main part of the openable/closable door.

FIG. 10 is a block diagram showing an electric configuration of a main part of the openable/closable door 1. As shown in FIG. 10, the control unit 91 is connected to the aforementioned electric motor 90 and door lock detection switch 92, and also to a door close detection switch 93 and a motor rotation amount sensor 94. Electric signals of the door lock detection switch 92, electric signals of the door close detection switch 93, and electric signals of the motor rotation amount sensor 94 are output to the control unit 91.

The door close detection switch 93 is provided in order to detect whether or not the sliding doors 11A, 11B are at the fully closed position, and is disposed in the vicinity of the sliding doors 11A, 11B, for example. For example, the door close detection switch 93 is configured, for example, to be turned on when the sliding doors 11A, 11B are at the fully closed position, and turned off when the sliding doors 11A, 11B are at the opened position.

The motor rotation amount sensor 94 is a rotary encoder, for example, and detects the rotation amount of the output shaft 90*a* of the electric motor 90. The control unit 91 calculates the positions of the sliding doors 11A, 11B that are displaced as a result of being driven by the output shaft 90*a*, based on the detected rotation amount. Further, the control unit 91 is connected to an operation unit (not shown), and signals of the operation unit are output to the control unit 91. The operation unit is provided for an operator such as a conductor to perform the opening and closing operations for the sliding doors 11A, 11B.

Next, the operations of opening, closing, and locking the sliding doors 11A, 11B will be described with reference to FIGS. 2 to 6.

[Description of Operation of Portions when in Unlocked State]

FIG. 2 shows a state where the sliding doors 11A, 11B are moving in the closing directions A1, A2, respectively, showing a state where the lock mechanism 60 is unlocked. In this state, the lock pins 14A, 14B are at positions separating away from the lock mechanism 60, and the lock mechanism 60 is retained in the state shown in FIG. 3, as described above.

In this unlocked state, the link mechanism 61 is in a bent state. The link mechanism 61 is sandwiched by the third engaging portions 69A, 69B of the engaging members 66A, 66B, and is thereby retained at the locking position. At this time, the movement in the locking direction C of the lock slider 33 with the projecting shaft 33*e* inserted in the groove 62*d* on the link 62*a* in the link mechanism 61 is constrained.

Referring to FIGS. 2 and 3, when the sun gear 21 in the planetary gear mechanism 20 is driven by the electric motor 90 in the unlocked state, the driving force that is input to the sun gear 21 is transmitted to the pinion 9 via the internal gear 22, or revolves the planetary gears 24 and rotates the carrier 23. In the case where the carrier 23 is rotated, the traction member 70 is displaced in the locking direction C, and the torque limiter spring 71 is elastically compressed.

The torque limiter spring 71 exerts a predetermined elastic force onto the carrier 23 via the traction member 70. The predetermined elastic force refers to an elastic force that is capable of suppressing the rotation of the carrier 23 that accompanies the revolution of the planetary gears 24 when the sliding doors 11A, 11B are moving from the opened position toward the fully closed position. This elastic force has a magnitude with which the torque limiter spring 71 is not compressed when the electric motor 90 performs driving to generate a first driving force X, which will be described later, that is smaller than the maximum value (e.g., 350N) of the first driving force X, and with which the torque limiter spring 71 is compressed when the electric motor 90 performs driving to generate this maximum value.

As a result of the rotation of the carrier 23 being restricted with the predetermined elastic force by the torque limiter spring 71, the planetary gears 24 do not revolve but rotate with the rotation of the sun gear 21 in the planetary gear mechanism 20 during a normal closing operation. Thus, the driving force of the sun gear 21 is transmitted to the pinion 9 via the internal gear 22, displaces the racks 7A, 7B in the closing directions A1, A2 or the opening directions B1, B2, and the sliding doors 11A, 11B are driven to open or close.

The positions of the engaging members 66A, 66B in a state of receiving a force from the lock pins 14A, 14B are retained by the connection spring 74. For this reason, the engaging members 66A, 66B do not pivot until the lock pins 14A, 14B come into contact with the first engaging portions 67A, 67B of the engaging members 66A, 66B. Thus, the lock mechanism 60 can be prevented from operating excessively early before the sliding doors 11A, 11B reach the fully closed position. Accordingly, it is possible to suppress collision of the lock pins 14A, 14B with portions of the engaging members 66A, 66B other than the first engaging portions 67A, 67B and a resulting failure of the lock mechanism 60.

[Description of Mechanical Operation During Operation of Closing Sliding Doors]

Next, a description will be given for a closing operation, which is an operation of moving the sliding doors 11A, 11B from the fully opened position to the fully closed position, and then locking the sliding doors 11A, 11B by the lock mechanism 60. First, in order to move the sliding doors 11A, 11B from the fully opened position to the fully closed position, the output shaft 90*a* of the electric motor 90 is rotated in one direction. Thus, the driving force of the electric motor 90 is transmitted to the sun gear 21, the planetary gears 24, and the internal gear 22 in this order, and the internal gear 22 rotates the pinion 9. Thus, the racks 7A, 7B and the sliding doors 11A, 11B move in the closing directions A1, A2. At this time, the rotation of the carrier 23 is restricted by the biasing force of the torque limiter spring 71.

Figure 11:
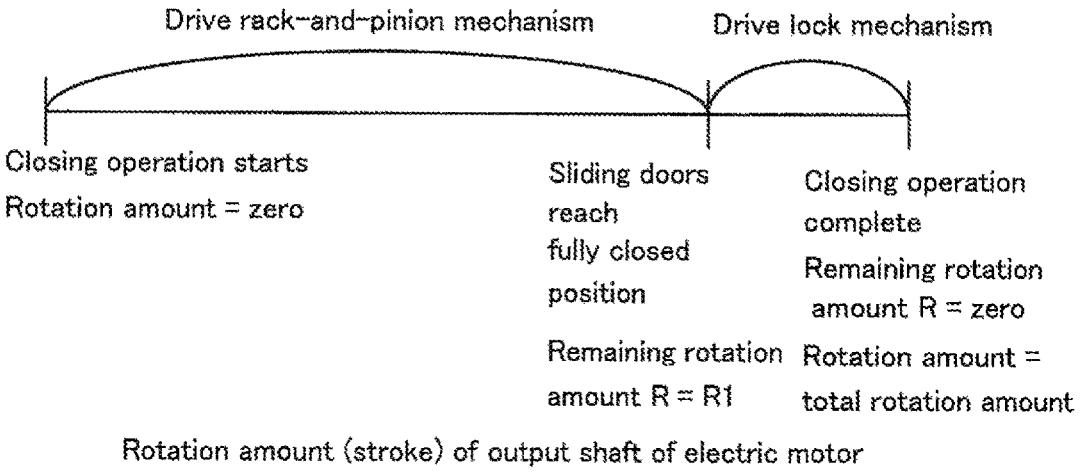
FIG. 11 is a conceptual diagram showing a relationship between the rotation amount (stroke) of an output shaft of an electric motor and an operation performed by means of driving of the electric motor.

FIG. 11 is a conceptual diagram showing a relationship between the rotation amount (stroke) of the output shaft 90*a* of the electric motor 90 and the operation performed by means of driving of the electric motor 90. As shown in FIGS. 2 and 11, the electric motor 90 operates as a driving source for displacing the sliding doors 11A, 11B in the closing directions A1, A2, while the output of the electric motor 90 is transmitted to the rack-and-pinion mechanism 10.

When the sliding doors 11A, 11B and the lock pins 14A, 14B reach the vicinity of the fully closed position as a result of the sliding doors 11A, 11B moving in the closing directions A1, A2, the lock pins 14A, 14B come into contact with the first engaging portions 67A, 67B of the engaging members 66A, 66B, as shown in FIG. 3. When the lock pins 14A, 14B further move in the closing directions A1, A2 in this state, the lock pins 14A, 14B pivot the engaging members 66A, 66B around the pivoting shafts 81A, 81B in the rotational directions E1, E2 against the elastic restoring force of the connection spring 74. Thus, the lock pins 14A, 14B go into the recessed portions of the first engaging portions 67A, 67B, as shown in FIG. 4.

At this time, the lock pins 14A, 14B have reached the fully closed position, together with the sliding doors 11A, 11B. The first engaging portions 67A, 67B are disposed so as to surround the lock pins 14A, 14B and engage with the lock pins 14A, 14B. At this time, portions of the first engaging portions 67A, 67B are located on the opening direction B1, B2 sides with respect to the lock pins 14A, 14B. The third engaging portions 69A, 69B have been disengaged from the pins 63*d*, 63*e* at the two ends of the link mechanism 61. Thus, the restriction on the displacement of the link mechanism 61 is canceled, and the link mechanism 61 is allowed to be displaced into a straight state.

For this reason, the lock slider 33 connected to the link mechanism 61 is capable of moving in the locking direction C. As shown in FIG. 5, when the sliding doors 11A, 11B reach the fully closed position, the movement of the sliding doors 11A, 11B in the closing directions A1, A2 is restricted due to the elastic members 12A, 12B coming into contact with each other, or the like. Accordingly, the rotation of the pinion 9 in the direction in which the sliding doors 11A, 11B are displaced in the closing directions A1, A2 is restricted, and furthermore, the rotation of the internal gear 22 connected to the pinion 9 is also restricted. When the output shaft 90*a* of the electric motor 90 is further rotated so as to rotate the sun gear 21 in this state, the planetary gears 24 revolve around the sun gear 21. Accordingly, the carrier 23 rotates counterclockwise in FIG. 5.

At this time, the electric motor 90 operates as a driving source for displacing the lock slider 33 in the lock mechanism 60 in the locking direction C. The traction member 70 moves in the locking direction C with the rotation of the carrier 23. As a result, the traction member 70, the torque limiter spring 71, and the lock slider 33 move in the locking direction C. When the lock slider 33 moves in the locking direction C, the projecting shaft 33*e* shown in FIG. 4 rotates the link 62*a* around the pin 63*a*. As a result, the link mechanism 61 transitions from a bent state (unlocking position) to a straight state (locking position) shown in FIG. 6.

When the link mechanism 61 is displaced to the locking position, the pins 63*d*, 63*e* at the two ends of the link mechanism 61 are disposed at the locking positions, and engage with the second engaging portions 68A, 68B. At this time, the link mechanism 61 restricts rotational displacement of the engaging members 66A, 66B. Accordingly, the movement in the opening directions B1, B2 of the lock pins 14A, 14B engaging with the first engaging portions 67A, 67B of the engaging members 66A, 66B is restricted. That is to say, as shown in FIG. 5, the sliding doors 11A, 11B are locked.

As described above, the lock mechanism 60 operates with the output of the electric motor 90 after the sliding doors 11A, 11B move to the fully closed position with the output of the electric motor 90, and the sliding doors 11A, 11B are thereby locked. Accordingly, locking of the sliding doors 11A, 11B that is linked to closing of the sliding doors 11A, 11B can be realized merely by driving the sun gear 21 in the planetary gear mechanism 20 with a single electric motor 90.

[Description of Mechanical Operation During Opening Operation]

Next, a description will be given for an operation of unlocking the sliding doors 11A, 11B locked by the lock mechanism 60 and then moving the sliding doors 11A, 11B from the fully closed position to the fully opened position, that is, an opening operation.

Note that the opening operation is achieved simply by rotating the output shaft 90*a* of the electric motor 90 in another direction that is opposite to the aforementioned one direction during the closing operation. More specifically, the output shaft 90*a* of the electric motor 90 is rotated in the other direction in the locked state shown in FIGS. 5 and 6. The carrier 23 thereby rotates in a clockwise direction in FIG. 5, and displaces the traction member 70 and the lock slider 33 in the unlocking direction D against the biasing force of the lock spring 73.

With the movement of the projecting shaft 33*e* of the lock slider 33 in the unlocking direction D, the link 62*a* in the link mechanism 61 rotates around the pin 63*a*. As a result, the link mechanism 61 transitions from a straight state (locking position) to a bent state (unlocking position) shown in FIG. 4. Thus, the pins 63*d*, 63*e* located at the ends of the link mechanism 61 are disengaged from the second engaging portions 68A, 68B of the engaging members 66A, 66B. Accordingly, the rotational displacement of the engaging members 66A, 66B is allowed, and the sliding doors 11A, 11B are unlocked. At this time, the engaging members 66A, 66B receive a biasing force that pivots them around the pivoting shafts 81A, 81B in directions opposite to the corresponding rotational directions E1, E2, due to the elastic restoring force of the connection spring 74 that connects the pair of engaging members 66A, 66B.

As shown in FIG. 2, when the rotation amount of the carrier 23 reaches a predetermined amount, the movement of the lock slider 33 in the unlocking direction D is constrained due to a deformation limit of the lock spring 73, for example. Note that the movement of the lock slider 33 in the unlocking direction D may be restricted not by the lock spring 73 that is compressed to its deformation limit, but alternatively by the carrier 23 and the base 5 coming into contact with each other at a predetermined position. This movement restriction may also be performed by appropriately setting the length of the guide grooves 80A, 80B (see FIG. 8) in which the pins 63*d*, 63*e* in the link mechanism 61 are inserted, thereby constraining the movement of the pins 63*d*, 63*e* with the guide grooves 80A, 80B. In this case, the movement of the lock slider 33 is constrained by constraining the deformation of the link mechanism 61.

Referring to FIG. 2, as a result of the restriction on the movement of the lock slider 33 in the unlocking direction D, the driving force of the sun gear 21 is then transmitted to the internal gear 22. Thus, the sliding doors 11A, 11B are displaced in the opening directions B1, B2 with the racks 7A, 7B in the rack-and-pinion mechanism 10, and the sliding doors 11A, 11B are displaced toward the fully opened position.

[Description Regarding Manual Opening Operation]

As shown in FIG. 5, an operation lever 96 is attached to the carrier 23 via a wire 95. The operation lever 96 is provided at a position where an attendant can operate the carrier 23 inside or outside the vehicle. As a result, in emergencies, for example, if the sliding doors 11A, 11B are locked in a state where a piece of luggage is stuck between the door leading ends of the sliding doors 11A, 11B at the fully closed position, an attendant or the like can operate the operation lever 96 by manpower. When the operation lever 96 is operated with a force at or above a certain level, the carrier 23 rotates in one direction (clockwise direction in FIG. 5) against the elastic force of the lock spring 73, and the traction member 70 and the lock slider 33 are thereby moved in the unlocking direction D. With the movement of the lock slider 33, the link mechanism 61 is displaced from the locking position to the unlocking position, and the sliding doors 11A, 11B are unlocked. Thus, the sliding doors 11A, 11B can be manually opened. Note that a configuration is also possible in which a lever is directly fixed to the lock slider 33, for the sake of a simpler configuration.

[Description of Case where Foreign Object Such as Luggage is Stuck Between Door Leading Ends of Sliding Doors]

Figure 12A:
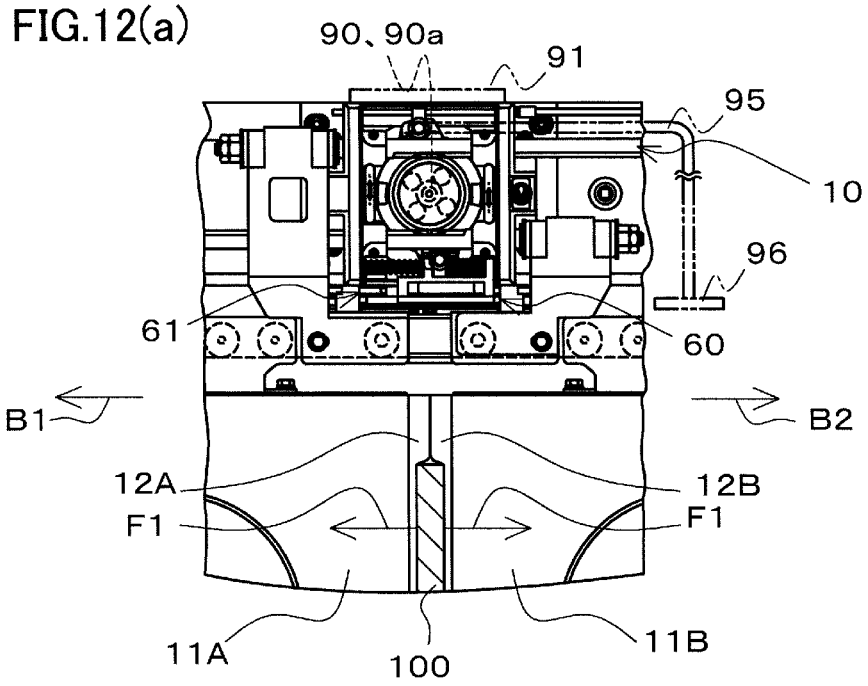
FIGS. 12(*a*) and 12(*b*) are diagrams for illustrating a case where a foreign object such as a piece of luggage is stuck between door leading ends of the sliding doors.
Figure 12B:
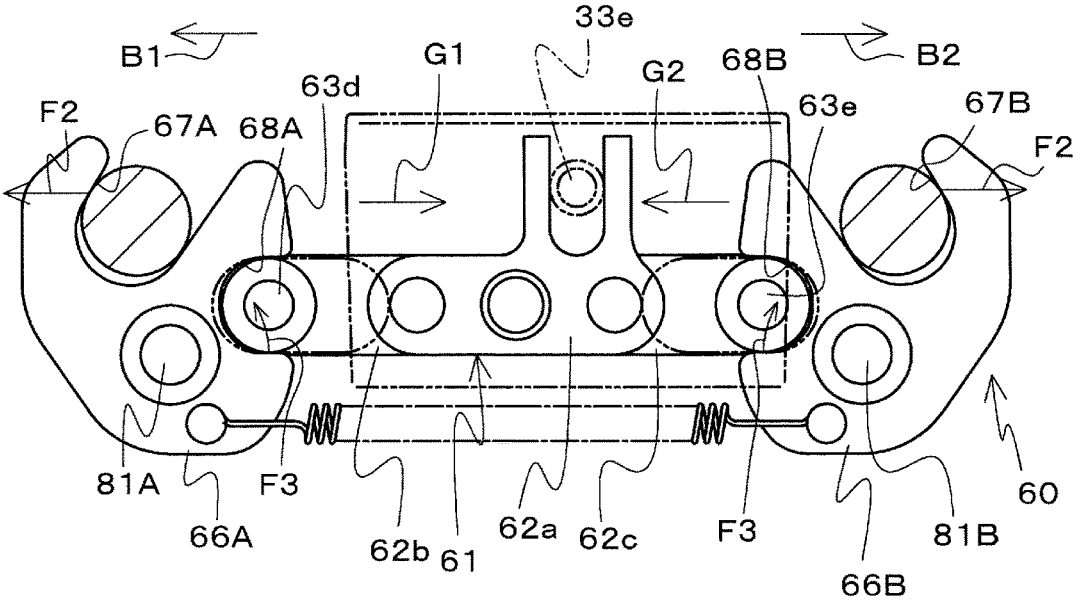

FIGS. 12(*a*) and 12(*b*) are diagrams for illustrating a case where a foreign object such as a piece of luggage is stuck between the door leading ends of the sliding doors 11A, 11B. FIG. 12(*a*) is a schematic front view of a main part of the surroundings of the sliding doors 11A, 11B, and FIG. 12(*b*) is a diagram showing the lock mechanism 60 as viewed from below.

As shown in FIGS. 12(*a*) and 12(*b*), there are cases where the sliding doors 11A, 11B are closed to the fully closed position in a state a piece of luggage 100, which serves as a foreign object, is stuck between the door leading ends of the sliding doors 11A, 11B, and furthermore, the sliding doors 11A, 11B are then locked. In such cases, the luggage 100 is stuck between the sliding doors 11A, 11B while elastically deforming the elastic members 12A, 12B of the sliding doors 11A, 11B. Thus, as a result of the elastic members 12A, 12B being disposed at the door leading ends of the sliding doors 11A, 11B, the sliding doors 11A, 11B can be closed to the fully closed position even in the case where the luggage 100 exists at the door leading ends, and the luggage 100 is not subjected to an excessive force.

However, if the reaction force exerted from the luggage 100 on the sliding doors 11A, 11B in the locked state is large for some reason, for example, for the reason that the luggage 100 is thick, the force required when an attendant manually operates the operation lever 96 in emergencies or the like is large. Specifically, the luggage 100 stuck between the elastic members 12A, 12B applies reaction forces F1, F1 respectively in the opening directions B1, B2 to the sliding doors 11A, 11B. Due to these reaction forces F1, F1 being exerted, the lock pins 14A, 14B apply loads F2, F2 in the opening directions B1, B2 to the first engaging portions 67A, 67B of the engaging members 66A, 66B. For this reason, rotational forces F3, F3 respectively around the pivoting shafts 81A, 81B are exerted on the engaging members 66A, 66B. These rotational forces F3, F3 are exerted on the pins 63*d*, 63*e* on the two ends of the link mechanism 61, and press the pins 63*d*, 63*e* against the edges of the second engaging portions 68A, 68B.

Here, the directions of the rotational forces F3, F3 are different from directions G1, G2 in which the link mechanism 61 at the unlocking position moves away from the engaging members 66A, 66B. For this reason, the rotational forces F3, F3 are exerted as prying forces by the link mechanism 61. For this reason, if the rotational forces F3, F3 are large, the load that needs to be given to the link mechanism 61 when the link mechanism 61 is separated (unlocked) from the engaging members 66A, 66B is large. Accordingly, if the sliding doors 11A, 11B are forcibly locked in a state where the reaction forces F1, F1 from the luggage 100 are large, the force required for unlocking is large. If the force required for unlocking is larger, a large force is required when the operation lever 96 is manually operated.

Therefore, in the present embodiment, the sliding doors 11A, 11B are enabled to promptly move from the fully opened position to the fully closed position, and the sliding doors 11A, 11B are prevented from being forcibly locked if the reaction forces F1, F1 from the luggage 100 is large. The following is a detailed description of this.

[Description of Control During Closing Operation]

A description will now be given for the flow of control of the closing operation for the openable/closable doors 1 by the control unit 91. During the closing operation, the control unit 91 controls the electric motor 90 for operating the rack-and-pinion mechanism 10 to move the sliding doors 11A, 11B along the closing directions A1, A2 up to the fully closed position, and then controls the electric motor 90 so as to displace the link mechanism 61 from the unlocking position to the locking position. Further, during the closing operation, the control unit 91 controls the electric motor 90 so as to reduce the output of the electric motor 90 from the first driving force X to the second driving force Y at a predetermined intermediate time point during the closing operation.

Figure 13:
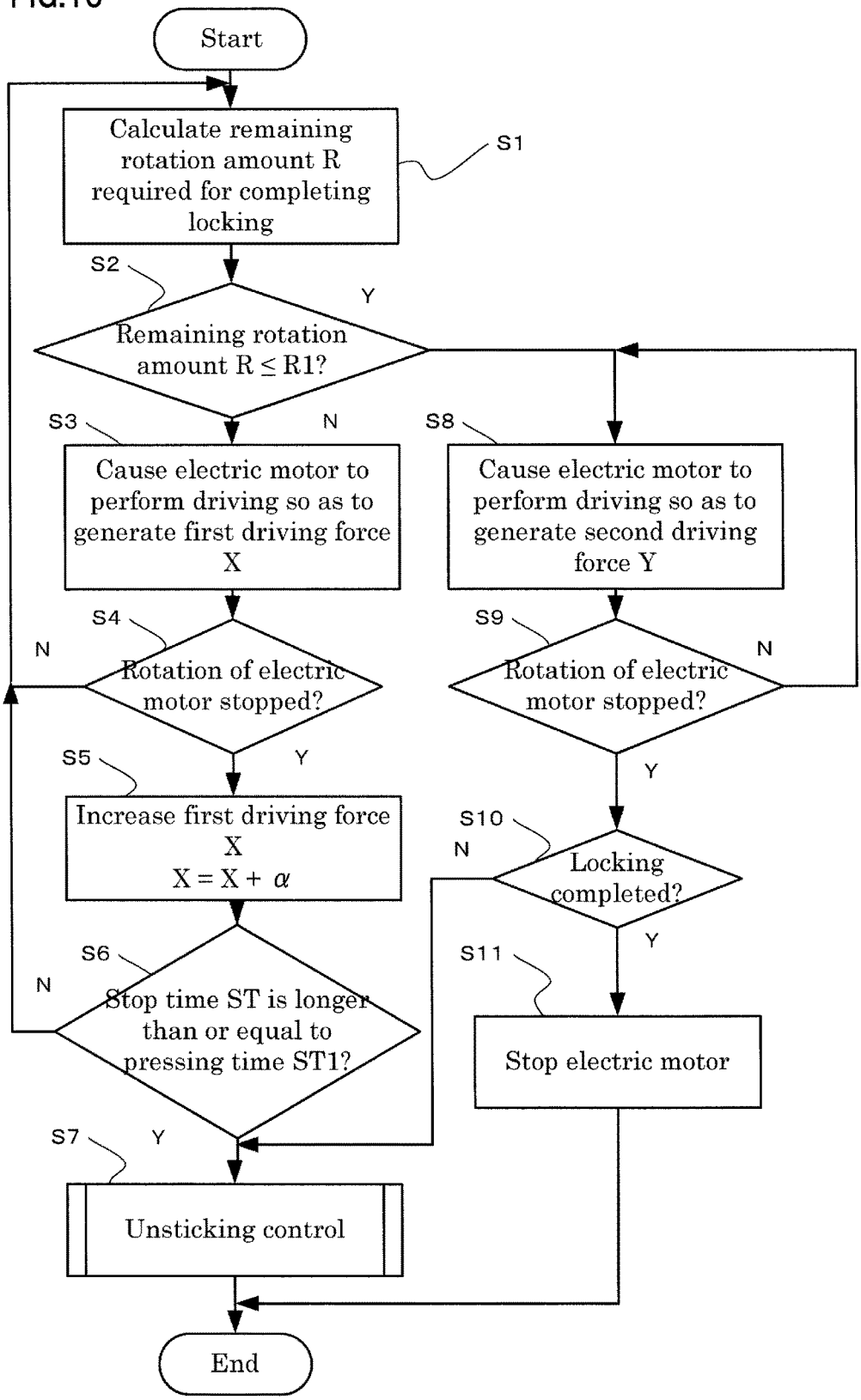
FIG. 13 is a flowchart for illustrating a flow of control by a control unit when a closing operation is performed.

FIG. 13 is a flowchart for illustrating the flow of control by the control unit 91 when the closing operation is performed. First, when a closing switch in an operation unit (not shown) is operated by a conductor of a railroad vehicle or the like in the state where the sliding doors 11A, 11B are at the fully opened position, a signal from this closing switch is output to the control unit 91. The control unit 91, upon receiving the signal, calculates the remaining rotation amount R of the output shaft 90*a* of the electric motor 90 required for completing locking, that is, for completing the closing operation (step S1).

Specifically, for example, the control unit 91 reads a signal from the motor rotation amount sensor 94. The control unit 91 calculates the rotation amount of the output shaft 90*a* since the start of the closing operation, based on the read signal, for example. Further, the total rotation amount of the output shaft 90*a* required for completing the closing operation is stored in the control unit 91. The control unit 91 calculates the remaining rotation amount R of the output shaft 90*a* required for completing locking by calculating the difference between the total rotation amount of the output shaft 90*a* and the rotation amount of the output shaft 90*a*.

Next, the control unit 91 determines whether or not the calculated remaining rotation amount R is smaller than or equal to a predetermined value R1 (step S2). In the present embodiment, the predetermined value R1 corresponds to the remaining rotation amount R at the time point when the sliding doors 11A, 11B reach the fully closed position from the opened position. That is to say, the time point when the remaining rotation amount R reaches the predetermined value R1 indicates the time point when the sliding doors 11A, 11B reach the fully closed position from the opened position and the position where the elastic members 12A, 12B of the sliding doors 11A, 11B start to come into contact with each other, and is the predetermined intermediate time point in the present embodiment. Further, the predetermined value R1 corresponds to the rotation amount of the output shaft 90*a* when the sliding doors 11A, 11B are displaced in the closing directions A1, A2 by about 20 mm to 30 mm, and this rotation amount is the rotation amount for the locking operation.

If the remaining rotation amount R is larger than the predetermined value R1 (step S2, NO), the control unit 91 determines that the sliding doors 11A, 11B have not yet reached the fully closed position. In this case, the control unit 91 causes the electric motor 90 to perform driving so as to generate the predetermined first driving force X (step S3). Thus, the output shaft 90*a* rotates, and the rack-and-pinion mechanism 10 moves the sliding doors 11A, 11B in the closing directions A1, A2. Thus, the sliding doors 11A, 11B move from the opened position toward the fully closed position.

The control unit 91 monitors whether the rotation of the output shaft 90*a* of the electric motor 90 has been forcibly stopped while causing the electric motor 90 to perform driving so as to generate the first driving force X (step S4). The control unit 91 determines the rotational state of the output shaft 90*a* based on the signal from the motor rotation amount sensor 94. While the sliding doors 11A, 11B are moving in the closing directions A1, A2, the output shaft 90*a* of the electric motor 90, which serves as the driving source for displacing the sliding doors 11A, 11B, is rotating. In this case, the rotation of the output shaft 90*a* has not stopped (step S4, NO). Accordingly, the control unit 91 causes the electric motor 90 to perform driving without changing the output of the electric motor 90 until the remaining rotation amount R becomes the predetermined value R1 (steps S1 to S4).

On the other hand, the output shaft 90*a* stops while the electric motor 90 is being displaced to the fully closed position in the case where a passenger strongly leans against the sliding doors 11A, 11B that are moving in the closing directions A1, A2 in a crowded train, or in the case where a passenger who is running into the vehicle is stuck between the sliding doors 11A, 11B, for example. In this case, the sliding doors 11A, 11B receive a large movement resistance from the passenger, and consequently, the output shaft 90*a* of the electric motor 90 stops.

If the output shaft 90*a* stops as described above in the case where the electric motor 90 performs driving with the first driving force X (step S4, YES), the control unit 91 increases the value of the first driving force X by a predetermined value a (step S5). That is to say, the control unit 91 increases the output of the electric motor 90. Although there is no particular limitation on the increment amount a of the first driving force X in this case, the first driving force X is not increased to a set upper limit value (e.g., 350N) of the first driving force X at one time. By increasing the first driving force X, the output shaft 90*a* of the electric motor 90 is rotated against the movement resistance exerted on the sliding doors 11A, 11B such that the sliding doors 11A, 11B can move to the fully closed position.

Next, the control unit 91 determines whether or not a stop time ST since the rotation of the output shaft 90*a* of the electric motor 90 was forcibly stopped has exceeded a pressing time ST1, which serves as a predetermined time (step S6). If the stop time ST is shorter than the pressing time ST1 (step S6, NO), the control unit 91 returns to step S1 and continues the processing. For example, in the case where a passenger is leaning against the sliding doors 11A, 11B, when the rotation of the output shaft 90*a* of the electric motor 90 is resumed by increasing the first driving force X (step S4, NO), the rotation of the output shaft 90*a* is continued with the first driving force X that was used when the rotation was resumed (steps S1 to S4).

On the other hand, if the rotation of the output shaft 90*a* is not resumed even though the first driving force X is increased (step S4, YES), in step S5, the control unit 91 controls the electric motor 90 so as to increase the first driving force X until the first driving force X reaches a predetermined threshold value Xmax (e.g., 350N) (steps S1 to S6).

If the rotation of the output shaft 90*a* of the electric motor 90 is not resumed even though the first driving force X has reached the predetermined threshold value Xmax due to, for example, a passenger being stuck between the sliding doors 11A, 11B (step S4, YES) and the stop time ST has reached the pressing time ST1 (step S6, YES), the control unit 91 performs unsticking control (step S7). The unsticking control refers to control for enabling a passenger or the luggage 100 that is stuck between the sliding doors 11A, 11B to be easily pulled out of the sliding doors 11A, 11B. In the unsticking control, the control unit 91 controls the electric motor 90 so as to reduce the output of the electric motor 90, set it to zero, or reverse the rotational direction of the electric motor 90.

Examples of the unsticking control may include control for alternately applying forces in the closing directions A1, A2 and forces in the opening directions B1, B2 to the sliding doors 11A, 11B by switching the rotational direction of the output shaft 90*a* of the electric motor 90 in a short time. Thus, the operation of pressing the sliding doors 11A, 11B against the passenger or the luggage 100 that is stuck between the sliding doors 11A, 11B and the operation of loosening the pressing can be repeated. Other examples of the unsticking control may include control for displacing the sliding doors 11A, 11B up to the fully opened position, or for displacing the sliding doors 11A, 11B in the opening directions B1, B2 by a predetermined amount and thereafter closing the sliding doors 11A, 11B again.

Note that in the above-described unsticking control, in the case where the output shaft 90*a* of the electric motor 90 stops while the sliding doors 11A, 11B are displaced in the closing directions A1, A2 again, the unsticking control may be repeated. Further, in the above-described unsticking control, after the operation of displacing the sliding doors 11A, 11B is repeated a predetermined number of times, the rotation of the output shaft 90*a* may be set to free-rotation by stopping electricity supply to the electric motor 90, or the like, to set the output of the electric motor 90 to zero. Further, in the above-described unsticking control, the output of the electric motor 90 may be reduced from the first driving force X.

On the other hand, when the remaining rotation amount R of the output shaft 90*a* of the electric motor 90 reaches the predetermined value R1 (step S2, YES), that is, when the predetermined intermediate time point in the closing operation is reached as a result of the sliding doors 11A, 11B reaching the fully closed position due to driving of the electric motor 90, the control unit 91 reduces the output of the electric motor 90 from the first driving force X to the second driving force Y (step S8). The value of the second driving force Y is smaller than the minimum value of the first driving force X. The minimum value of the first driving force X is the value of the first driving force X in the case where the first driving force X is never increased in step S5 when the remaining rotation amount R of the output shaft 90*a* is larger than the predetermined value R1. For example, the second driving force Y is about 190N.

In the present embodiment, the electric motor 90 performs driving to generate the second driving force Yin the case where the sliding doors 11A, 11B reach the fully closed position and the lock mechanism 60 is operated by the electric motor 90. In this case, as described above, the carrier 23 is rotated by the rotation of the output shaft 90*a* of the electric motor 90. In the case where the electric motor 90 performs driving to generate the second driving force Y, the control unit 91 determines whether or not the rotation of the output shaft 90*a* of the electric motor 90 has stopped (step S9).

If the rotation of the output shaft 90*a* has not stopped (step S9, NO), the control unit 91 continues driving of the electric motor 90 so as to generate the fixed second driving force Y (steps S8, S9). Thus, the rotation of the carrier 23 and the displacement of the lock slider 33 in the locking direction C are continued, and the link mechanism 61 is displaced to the locking position.

On the other hand, if the rotational driving of the output shaft 90*a* of the electric motor 90 is stopped (step S9, YES), the control unit 91 determines whether or not the locking operation has been completed (step S10). Note that it is determined in step S9 that the electric motor 90 has stopped in the case where the locking operation has been completed as a result of the link mechanism 61 being displaced to the locking position, or in the case where the sliding doors 11A, 11B were forcibly stopped due to the luggage 100 or the like that was stuck between the sliding doors 11A, 11B.

In step S10, the control unit 91 determines that the locking operation has been completed when both the door close detection switch 93 and the door lock detection switch 92 are in an on state (step S10, YES).

More specifically, if the locking operation has been completed, the pins 63*d*, 63*e* at the two ends of the link mechanism 61 are engaged with the second engaging portions 68A, 68B by the traction member 70 and the lock slider 33 that were displaced in the locking direction C with the rotation of the carrier 23, thus completing locking. Thus, in the case where the output shaft 90*a* of the electric motor 90 has rotated until locking is complete, the rotation amount of the carrier 23 reaches the predetermined amount, and consequently, the door lock detection switch 92 is turned on. Further, in this case, the door close detection switch 93 is also in an on state since the sliding doors 11A, 11B are at the fully closed position. Accordingly, it is determined that the closing operation has been completed (step S10, YES), and the electric motor 90 is stopped (step S11), thereby ending the processing.

On the other hand, if the rotation of the output shaft 90*a* of the electric motor 90 has stopped even though the door lock detection switch 92 is in an off state, it is determined in step S10 that the locking operation has not been completed (step S10, NO). More specifically, in this case, the output shaft 90*a* of the electric motor 90 has stopped due to the luggage 100 stuck between the sliding doors 11A, 11B. In this case, the sliding doors 11A, 11B are slightly open due to the reaction force from the luggage 100 as a result of the output of the electric motor 90 being reduced from the first driving force X to the second driving force Y. At this time, the driving force of the electric motor 90 is transmitted to the rack-and-pinion mechanism 10 via the sun gear 21, the planetary gears 24, and the internal gear 22, such that the sliding doors 11A, 11B are displaced to the fully closed position. However, in this case, the rack-and-pinion mechanism 10 cannot be moved against the reaction force from the luggage 100 since the second driving force Y is small. Accordingly, the output shaft 90*a* of the electric motor 90 stops.

As described above, in the case where the rotation of the electric motor 90 has stopped due to a foreign object such as the luggage 100 being stuck between the sliding doors 11A, 11B, the door lock detection switch 92 remains in an off state. Accordingly, the control unit 91 determines that the locking operation has not been completed and the electric motor 90 has been forcibly stopped (step S10, NO), and performs the unsticking control (step S7).

As described above, with the opening and closing apparatus with a lock 2 in the present embodiment, the first driving force X serving as the output of the electric motor 90 is increased until the predetermined intermediate time point (time point before reaching step S8) during the closing operation. For this reason, a decrease in the closing speed of the sliding doors 11A, 11B can be suppressed while the sliding doors 11A, 11B are being displaced toward the fully closed position with the output of the electric motor 90, and it is therefore possible to promptly close the sliding doors 11A, 11B. For example, even if a large movement resistance is exerted on the sliding doors 11A, 11B due to a passenger leaning against the sliding doors 11A, 11B while the sliding doors 11A, 11B are being closed in a crowded train, the force of closing the sliding doors 11A, 11B is sufficiently large. Thus, it is possible to continue to promptly close the sliding doors 11A, 11B. In particular, maintenance of scheduled service is strongly demanded for railroad vehicles, and realization of a prompt full-closing operation for the sliding doors 11A, 11B will significantly contribute to an improvement in the maintenance of scheduled service. Further, the output of the electric motor 90 is reduced from the first driving force X to the second driving force Y at the predetermined intermediate time point (time point of step S8) during the closing operation. Thus, the output of the electric motor 90 when the link mechanism 61 is displaced to the locking position and engages with the engaging members 66A, 66B can be made small. For example, when the sliding doors 11A, 11B are at the fully closed position in a state where the luggage 100 is stuck between the door leading ends of the sliding doors 11A, 11B, the luggage 100 is pressing the sliding doors 11A, 11B in the opening directions B1, B2 via the elastic members 12A, 12B. If the reaction force from the luggage 100 is large in this case, the sliding doors 11 are slightly displaced in the opening directions B1, B2 after reaching the fully closed position once. For this reason, the sliding doors 11A, 11B are not locked. Also in the case where a piece of luggage is stuck between the door leading ends of the sliding doors 11A, 11B and the sliding doors 11A, 11B do not move at the closed position, the sliding doors 11A, 11B are not locked. Accordingly, the sliding doors 11A, 11B are prevented from being forcibly locked with a large force. Even if the sliding doors 11A, 11B are locked in a state where a thin piece of luggage 100 or the like is stuck between the door leading ends, the reaction force from the luggage 100 in this case is small. Accordingly, the engaging force exerted between the lock pins 14A, 14B and the engaging members 66A, 66B is small, and consequently, the prying force exerted between the engaging members 66A, 66B and the link mechanism 61 is also small. For this reason, for example, in the case of unlocking the sliding doors 11A, 11B by manually displacing the link mechanism 61 from the locking position to the unlocking position and pulling out the luggage 100 stuck between the door leading ends, only a small force is required for the manual operation. Accordingly, a force amplifying mechanism such as a pulley mechanism for amplifying manpower for manual unlocking is not necessary. Accordingly, it is not necessary to add a new mechanism for manual unlocking to the opening and closing apparatus with a lock 2, and the configuration of the opening and closing apparatus with a lock 2 can be simplified. In the case where the luggage 100 is thin, unlocking is not performed even if the sliding doors 11A, 11B are locked in a state where the luggage 100 is stuck, and the luggage 100 can be easily pulled out of the sliding doors 11A, 11B.

Accordingly, with the opening and closing apparatus with a lock 2, it is possible to safely and promptly close the sliding doors 11A, 11B, and furthermore to easily perform unlocking with a simple configuration.

According to the present embodiment, the output of the electric motor 90 is reduced at the time point when the sliding doors 11A, 11B reach the fully closed position from the opened position, that is, at the time point when the elastic members 12A, 12B at the door leading ends of the sliding doors 11A, 11B come into contact with each other. For this reason, when the elastic members 12A, 12B of the sliding doors 11A, 11B are moving toward the fully closed position so as to come into contact with the elastic members 12B, 12A on the opposite sliding doors 11B, 11A, the sliding doors 11A, 11B can be promptly displaced in the closing directions A1, A2 with a large output (first driving force X) from the electric motor 90. For example, in the case where a piece of luggage 100 is stuck between the door leading ends of the sliding doors 11A, 11B and the reaction force from this luggage 100 is large, the sliding doors 11A, 11B move in the opening directions B1, B2 against the second driving force Y of the electric motor 90 at an early stage after the luggage 100 is stuck between the sliding doors 11A, 11B, and it is thus possible to prevent the locking operation from being performed. Accordingly, the luggage 100 can be pulled out of the sliding doors 11A, 11B at an earlier time point, and the damage to the luggage 100 can also be made small.

According to the present embodiment, at the time point before the predetermined intermediate time point (step S8) during the closing operation, if the electric motor 90 is forcibly stopped (step S4, YES), the control unit 91 increases the first driving force X of the electric motor 90 (step S5). For example, if a passenger leans against the sliding doors 11 and a large movement resistance is exerted on the sliding doors 11 when the sliding doors 11A, 11B are closed in a crowded train, the output of the electric motor 90 is increased. Thus, a decrease in the closing speed of the sliding doors 11A, 11B can be suppressed, and a prompt closing operation for the sliding doors 11A, 11B can be reliably performed.

According to the present embodiment, if a state where the electric motor 90 is forcibly stopped continues for the predetermined pressing time ST1 (step S6, YES), the control unit 91 performs the unsticking control (step S7). For example, if a passenger runs into a crowded train and is stuck between the sliding doors 11A, 11B when the sliding doors 11A, 11B are closed, the electric motor 90 is forcibly stopped. If such a state continues for the pressing time ST1, the unsticking control is performed. Thus, the passenger is enabled to easily get out of the sliding doors 11A, 11B. Thus, at the stage before the predetermined intermediate time point (step S8), a person, a piece of luggage 100, or the like that is stuck between the sliding doors 11A, 11B can be easily pulled out of the sliding doors 11A, 11B.

According to the present embodiment, at a time point at or after the predetermined intermediate time point (step S8) during the closing operation, the control unit 91 controls the electric motor 90 such that the second driving force Y is constant. For this reason, at or after the predetermined intermediate time point (step S8) during the closing operation, even if a thick piece of luggage 100 or the like is stuck between the door leading ends of the sliding doors 11A, 11B, the output of the electric motor 90 is not increased, and the operation of forcibly closing the sliding doors 11A, 11B is not performed. Therefore, in the case where the thick luggage 100 or the like is stuck between the door leading ends of the sliding doors 11A, 11B, the sliding doors 11A, 11B are prevented from being forcibly locked. Accordingly, only a small force is exerted between the engaging members 66A, 66B in the lock mechanism 60 and the link mechanism 61. Therefore, even in the case where unlocking needs to be performed by manually operating the link mechanism 61, it is possible to easily disengage the link mechanism 61 from the engaging members 66A, 66B and perform unlocking with a small force.

According to the present embodiment, at a time point at or after the predetermined intermediate time point (step S8) during the closing operation, the control unit 91 performs the unsticking control at the time point when the electric motor 90 is forcibly stopped (step S10, NO). Thus, at or after the predetermined intermediate time point (step S8), for example, if the electric motor 90 has been forcibly stopped due to a piece of luggage 100 being stuck between the door leading ends, the output mode of the electric motor 90 is immediately changed. Accordingly, forcible continuation of the locking operation for the sliding doors 11A, 11B can be suppressed, and it is therefore possible to easily and promptly pull out the luggage 100 or the like from the door leading ends by human hands.

According to the present embodiment, the second driving force Y is smaller than the minimum value of the first driving force X of the electric motor 90. For this reason, the output of the electric motor 90 at and after the predetermined intermediate time point (step S8) can be reliably set to a small value. Thus, at a time point before the predetermined time point (step S8), the sliding doors 11A, 11B are closed forcefully and promptly, and from the predetermined time point (step S8) onward, forcible locking of the sliding doors 11A, 11B can be suppressed in the case where a piece of luggage is stuck between the door leading ends of the sliding doors 11A, 11B.

According to the present embodiment, the engaging members 66A, 66B are configured to be capable of rotating around the pivoting shafts 81A, 81B as a result of coming into contact with the lock pins 14A, 14B, and the rotation is restricted by the engagement with the link mechanism 61. Thus, smooth engagement and disengagement between the lock pins 14A, 14B and the engaging members 66A, 66B can be realized. Further, when the sliding doors 11A, 11B are at the fully closed position, the rotation of the engaging members 66A, 66B is restricted by the link mechanism 61, and the displacement of the lock pins 14A, 14B that are hooked at the engaging members 66A, 66B is thereby restricted. As a result, in the case where a piece of luggage 100 is stuck between the sliding doors 11A, 11B, the reaction force from the luggage 100 is transmitted from the lock pins 14A, 14B to the engaging members 66A, 66B, and the engaging members 66A, 66B press the link mechanism 61 around the pivoting shafts 81A, 81B. Since this pressing force (rotational forces F3, F3) becomes a prying force, this prying force makes it difficult to pull the link mechanism 61 out of the engaging members 66A, 66B. However, according to the present embodiment, the sliding doors 11A, 11B are locked only when the reaction force from the luggage 100 is small, and accordingly, it is easy to perform the operation of manually pulling the link mechanism 61 out of the engaging members 66A, 66B, that is, the manual unlocking operation.

According to the present embodiment, the third engaging portions 69A, 69B of the engaging members 66A, 66B restrict the displacement of the link mechanism 61 to the locking position when the sliding doors 11A, 11B are at the opened position. Thus, when the sliding doors 11A, 11B are at the opened position, the displacement of the link mechanism 61 to the locking position is restricted. Accordingly, it is possible to reliably suppress unintended displacement of the link mechanism 61 to the locking position while the sliding doors 11A, 11B are being displaced from the opened position to the fully closed position.

According to the present embodiment, the planetary gear mechanism 20 can transmit the output of the electric motor 90 from the sun gear 21 to the rack-and-pinion mechanism 10 when the sliding doors 11A, 11B are at the opened position. Furthermore, the planetary gear mechanism 20 can transmit the output of the electric motor 90 from the carrier 23 to the link mechanism 61 when the sliding doors 11A, 11B are at the fully closed position. With this configuration, the configuration for distributing the output of the electric motor 90 can be accommodated in a compact space. As a result, the configuration of the opening and closing apparatus with a lock 2 can be further simplified.

According to the present embodiment, the electric motor 90 can be used as an actuator with a simple structure, and it is therefore possible to further simplify the configuration of the opening and closing apparatus with a lock 2.

According to the present embodiment, the control unit 91 calculates that the predetermined intermediate time point has been reached, based on the rotation amount of the output shaft 90*a* of the electric motor 90. Thus, during the closing operation, the control unit 91 can easily calculate that the predetermined intermediate time point has been reached, based on the rotation amount of the output shaft 90*a*.

Although an embodiment of the present invention has been described above, the present invention is not limited to the above-described embodiment, and various modifications may be implemented within the scope recited in the claims. For example, the following modifications may be implemented.

(1) Although the above embodiment was described for the configuration in which two-panel sliding doors having a pair of sliding doors are opened and closed, this need not be the case. For example, the present invention may be applied to a one-panel sliding door having a sliding door. In this case, the elastic member at the door leading end of the sliding door closes the entrance where the sliding door is disposed, in conjunction with the inner surface of the door frame of the vehicle.

(2) Although the above embodiment was described for the configuration in which the actuator of the opening and closing apparatus with a lock is an electric motor, the moving mechanism is a rack-and-pinion mechanism, and the lock mechanism is a link mechanism serving as an engaging member, this need not be the case. The actuator, the moving mechanism, and the lock mechanism may have other configurations.

(3) Although the above embodiment was described for the configuration in which the predetermined time point during the closing operation is the time point when the elastic members of the sliding doors come into contact with each other, this need not be the case.

(4) Although the above embodiment was described for the configuration in which the second driving force of the electric motor is set lower than the minimum value of the first driving force of the electric motor during the closing operation, this need not be the case. The second driving force need only be smaller than the maximum value of the first driving force.

(5) Although the above embodiment was described for the configuration in which the sun gear is connected to the output shaft of the electric motor, the internal gear is connected to the pinion, and the carrier is connected to the traction member, this need not be the case. Various modifications can be applied, such as a modification in which the sun gear is connected to the pinion and the internal gear is connected to the electric motor.

INDUSTRIAL APPLICABILITY

The present invention is widely applicable to an opening and closing apparatus with a lock for performing an opening and closing operation and a locking operation for a vehicle sliding door, using an actuator.

DESCRIPTIONS OF REFERENCE NUMERALS

2 Opening and closing apparatus with lock
10 Rack-and-pinion mechanism (moving mechanism)
11A, 11B Sliding door
12A, 12B Elastic member
14A, 14B Lock pin (lock member)
20 Planetary gear mechanism
21 Sun gear (input portion)
22 Internal gear (first output portion)
23 Carrier (second output portion)
60 Lock mechanism
61 Link mechanism (restricting member)
66A, 66B Engaging member
67A, 67B First engaging portion
68A, 68B Second engaging portion
69A, 69B Third engaging portion
81A, 81B Pivoting shaft
90 Electric motor (actuator)
91 Control unit
101 Entrance
A1, A2 Closing direction
B1, B2 Opening direction
X First driving force
Y Second driving force

The invention claimed is:

1. An opening and closing apparatus with a lock for opening and closing a sliding door that is installed at an entrance of a vehicle and is provided with an elastic member at its door leading end, the opening and closing apparatus with a lock comprising:

an actuator;

a moving mechanism for moving the sliding door in a predetermined opening direction and closing direction, using output of the actuator;

a lock mechanism that is moved to a locking position by output of the actuator so that the lock mechanism at the locking position restricts movement of the sliding door in the opening direction when the sliding door is at a fully closed position; and a control unit for controlling the actuator, wherein the control unit controls the actuator such that a closing operation is performed, the closing operation serving as an operation of operating the moving mechanism so as to move the sliding door along the closing direction to the fully closed position and, at a predetermined intermediate time point during the closing operation, changes the output of the actuator from a predetermined first driving force to a second driving force which is lower than the first driving force, and the lock mechanism is moved to the locking position by the actuator once the control unit determines a value of the second driving force.

2. The opening and closing apparatus with a lock according to claim 1, wherein a pair of sliding doors are provided such that door leading ends thereof face each other, and the predetermined intermediate time point during the closing operation is a time point when the sliding doors reach a position where the elastic members of the sliding doors come into contact with each other.

3. The opening and closing apparatus with a lock according to claim 1, wherein at a time point before the predetermined intermediate time point during the closing operation, if the actuator is forcibly stopped, the control unit controls the actuator so as to increase the first driving force.

4. The opening and closing apparatus with a lock according to claim 3, wherein if a state where the actuator is forcibly stopped continues for a predetermined time, the control unit controls the actuator so as to reduce the output of the actuator, set the output of the actuator to zero, or reverse a direction of the output of the actuator.

5. The opening and closing apparatus with a lock according claim 1, wherein at a time point at or after the predetermined intermediate time point during the closing operation, the control unit controls the actuator such that the second driving force is constant.

6. The opening and closing apparatus with a lock according to claim 1, wherein at a time point at or after the predetermined intermediate time point during the closing operation, when the actuator is forcibly stopped, the control unit controls the actuator so as to reduce the output of the actuator, set the output of the actuator to zero, or reverse a direction of the output of the actuator.

7. The opening and closing apparatus with a lock according to claim 1, wherein the second driving force is set smaller than a minimum value of the first driving force.

8. The opening and closing apparatus with a lock according to claim 1, wherein the engaging member is configured to be capable of rotating around a predetermined pivoting shaft as a result of coming into contact with the lock member, and the engaging member has a first engaging portion, at least part of the first engaging portion is disposed on the opening direction side with respect to the lock member when the sliding door is at the fully closed position, and a second engaging portion that engages with the restricting member located at the locking position, and the rotation of the engaging member is restricted by the engagement between the restricting member and the second engaging portion.

9. The opening and closing apparatus with a lock according to claim 8, wherein the engaging member has a third engaging portion that engages with the restricting member so as to restrict displacement of the restricting member to the locking position when the sliding door is at an opened position.

10. The opening and closing apparatus with a lock according to claim 1, further comprising a planetary gear mechanism for selectively distributing the output of the actuator to one of the moving mechanism and the lock mechanism, wherein the planetary gear mechanism has an input portion to which the output of the actuator is input, a first output portion capable of transmitting the output to the moving mechanism, and a second output portion capable of transmitting the output to the restricting member, the planetary gear mechanism being capable of transmitting the output from the first output portion to the moving mechanism when the sliding door is at the opened position, and capable of transmitting the output from the second output portion to the restricting member when the sliding door is at the fully closed position.

11. The opening and closing apparatus with a lock according to claim 1, wherein the actuator includes an electric motor.

12. The opening and closing apparatus with a lock according to claim 11, wherein the control unit calculates the predetermined intermediate time point based on a rotation amount of an output shaft of the electric motor.

* * * * *